US011566416B2

(12) United States Patent
Lee et al.

(10) Patent No.: US 11,566,416 B2
(45) Date of Patent: Jan. 31, 2023

(54) PPVC CONNECTOR

(71) Applicant: KCL CONSULTANTS PTE LTD, Singapore (SG)

(72) Inventors: Yee Seng Lee, Singapore (SG); Jianhan Kang, Singapore (SG)

(73) Assignee: KCL CONSULTANTS PTE LTD, Singapore (SG)

( * ) Notice: Subject to any disclaimer, the term of this patent is extended or adjusted under 35 U.S.C. 154(b) by 229 days.

(21) Appl. No.: 17/055,977

(22) PCT Filed: Apr. 29, 2019

(86) PCT No.: PCT/SG2019/050237
§ 371 (c)(1),
(2) Date: Nov. 16, 2020

(87) PCT Pub. No.: WO2019/221668
PCT Pub. Date: Nov. 21, 2019

(65) Prior Publication Data

US 2021/0207364 A1 Jul. 8, 2021

(30) Foreign Application Priority Data

May 17, 2018 (SG) ..... 10201804186R
Jul. 6, 2018 (SG) ..... PCT/SG2018/050334

(51) Int. Cl.
*E04B 1/61* (2006.01)
*E04B 1/04* (2006.01)
(Continued)

(52) U.S. Cl.
CPC ..... *E04B 1/6162* (2013.01); *E04B 1/043* (2013.01); *E04C 2/34* (2013.01); *E04B 2103/02* (2013.01);
(Continued)

(58) Field of Classification Search
USPC ..... 403/364, 339, 340
See application file for complete search history.

(56) References Cited

U.S. PATENT DOCUMENTS 3,348,459 A * 10/1967 Harvey ..... E01C 9/083 404/35
3,512,819 A * 5/1970 Gillingwater ..... E04B 1/6158 52/461
(Continued)

FOREIGN PATENT DOCUMENTS

EP 3263795 A1 * 1/2018 ..... E04B 1/348
WO WO-2015070956 A1 * 5/2015 ..... E04B 1/043

*Primary Examiner* — Joshua K Ihezie
(74) *Attorney, Agent, or Firm* — Idea Intellectual Limited; Margaret A. Burke; Sam T. Yip

(57) ABSTRACT

A PPVC connector is provided for joining a first PPVC (Prefabricated Prefinished Volumetric Construction) module and a second PPVC module. The PPVC connector is adopted for coupling or joining a first PPVC module and a second PPVC module together, comprising a first anchor for attaching to the first PPVC module; a second anchor for attaching to the second PPVC module; and a frame for coupling the first anchor and the second anchor together. The first anchor, the second anchor, the frame or a combination of any of these components comprise a plate having at least one side for attaching to one of the PPVC Module. Due to confinement effect, the first module and the second module are prevented from detachment so as to bind the first PPVC module and the second PPVC module together permanently to form a monolithic assemble.

19 Claims, 23 Drawing Sheets

(51) Int. Cl.
*E04C 2/34* (2006.01)
*E04C 2/04* (2006.01)
*E04C 2/00* (2006.01)

(52) U.S. Cl.
CPC ..... *E04C 2/044* (2013.01); *E04C 2002/001* (2013.01)

(56) References Cited

U.S. PATENT DOCUMENTS 3,640,039 A * 2/1972 McKee ..... E04B 1/6158 52/396.04
3,884,005 A * 5/1975 Wey ..... E04B 1/043 403/294
5,007,222 A * 4/1991 Raymond ..... F24F 13/20 52/775
5,592,794 A * 1/1997 Tundaun ..... E04B 1/6162 52/582.1
7,418,805 B2 * 9/2008 Tan ..... E04B 2/7425 52/234
7,481,406 B2 * 1/2009 Lang ..... A47F 5/0815 248/220.42
7,665,264 B1 * 2/2010 Wolfe ..... E04B 5/023 52/763
9,133,620 B1 * 9/2015 Huguet, Sr. ..... E04C 2/34
2003/0196404 A1 * 10/2003 Dennis ..... E04B 1/043 52/582.1
2006/0201090 A1 * 9/2006 Guevara ..... C04B 16/08 52/309.12
2009/0100780 A1 * 4/2009 Mathis ..... E04C 2/296 52/794.1
2021/0140175 A1 * 5/2021 Douglas ..... E04C 2/284

* cited by examiner

PPVC CONNECTOR

The present application claims a filing date of a Singapore patent application Nr. 10201804186R as priority, which was filed with IPOS (Intellectual Property Office of Singapore) on 17 May 2018, and has the title of Connector for PPVC Modules. The present application also claims a filing date of international patent application Nr. PCT/SG2018/050334 as priority, which has an international filing date of 6 Jul. 2018, and a title of PPVC Connector. Relevant content and/or subject matter of these two earlier priority patent applications is/are hereby incorporated by reference wherever appropriate.

The present application relates to one or more PPVC (Prefabricated Prefinished Volumetric Construction) connectors for coupling PPVC modules together. The application also relates one or more methods for making, assembling, disassembling, installing, configuring, maintaining, repairing and using the one or more PPVC connectors in order to couple the PPVC modules.

To raise construction productivity and fundamentally improve design and construction processes, Building and Construction Authority of Singapore (BCA) encourages construction industry to embrace a concept of Design for Manufacturing and Assembly (DfMA), whereby construction may be done off-site in a controlled manufacturing environment as much as possible.

PPVC is one of the game changing technologies that support the DfMA concept to significantly speed up building construction. PPVC can potentially achieve a productivity improvement of up to 50% in terms of manpower and time savings, depending on complexity of relevant projects. Furthermore, dust and noise pollution can be minimised as more activities are done off-site (i.e. away from building construction site). With the bulk of installation activities and manpower moved off-site to a factory controlled environment, building construction site safety is also improved.

Though important, known connection between PPVC modules is inherently weak because walls, floors or side panels of different PPVC modules are prefabricated separately in factories, instead of constructed or cured together onsite continuously. Hence, the present application aims to provide one or more new and useful PPVC connectors for coupling multiple PPVC modules, which are known as building elements as well. Particularly, the PPVC connector of the present application has a rigid nature and can provide confined space for inducing confinement effect between the PPVC connector and the fillers. By filling and curing fillers into the confined space, the PPVC connector makes two or more PPVC modules into a monolithic assembly by forming a continuous reinforced structure in-between the PPVC modules. The present application further aims to provide one or more new and useful methods for making, assembling, disassembling, installing, configuring, maintaining, repairing and using the PPVC connector for coupling building elements or PPVC modules. Essential features of relevant inventions are provided by one or more independent claims, whilst advantageous features of these inventions are presented by their corresponding dependent claims respectively.

According to an aspect, the present application provides a PPVC (Prefabricated Prefinished Volumetric Construction) connector that is typically fabricated before installation in order to couple, join, bind or fix a first PPVC module and a second PPVC module together permanently or temporarily. The PPVC connector, either rigid or flexible are used for coupling or joining a first PPVC module and a second PPVC module together. The PPVC connector comprises the first anchor for being attached to or embedded into/onto a wall (e.g. ceiling, floor, sidewall) of the first PPVC module. The PPVC connector also comprises the second anchor for being attached to or embedded into/onto the second PPVC module with non-shrink grout. The PPVC connector further comprises a frame either rigid or flexible (e.g. metal rod, rebar, plate or sheet) operable for coupling the first anchor and the second anchor together. The frame is usually a hard, tough, strong structural component or structure, although the frame is optionally resilient or springy. The first anchor, the second anchor, the frame or a combination of any of these components comprises a plate having one or more sides for attaching to one of the PPVC Module. The first PPVC module and the second PPVC module are laterally arranged, being next to each other. For example, the first PPVC module and the second PPVC module are substantially at the same level or on the same floor.

The plate comprises a single or multiple sides for respectively attaching to one of the PPVC modules. For example, the plate is folded laterally for having a plurality of sides to be attached to the first PPVC module or the second PPVC module. The multiple sides of the plate may comprise opposing or opposite sides (e.g. sides that face each other) for respectively attaching to one of the PPVC modules. In this design, the opposing or opposite sides can define a trough between the two plates. For instance, if two opposite edges of the elongated plate are folded symmetrically towards each other, the elongated plate forms a trough that is able to receive grout or other types of fillers. For the convenience of usage or installation, a longitudinal direction of the elongated plate is substantially parallel to a vertical or height direction of a PPVC module before or after its coupling.

The first anchor, the second anchor and the rigid or flexible frame or a combination of any of these components are configured to enclose or surround a substantially confined cavity or space in-between for receiving a filler in order to create a confinement effect. Current PPVC connectors are usually flexible, such as a string, a rope or a floppy wire that is not capable of maintain or keep a predetermined formation in the absence of external force. Even after adding a filler such as concrete within the current PPVC connectors, the filler still tends to depart from the current PPVC connectors after curing since no squeezing force is generated by a confinement effect. A longitudinal deformation and a transversal deformation occur when the mixed structure is under axial loading for a building, since the Poisson's ratio of concrete is smaller than that of the steel during the initial loading stage. Moreover, even if current PPVC connectors are adopted in the mixture for trying to obtain a confinement effect, a high volumetric ratio of the current PPVC connectors in the mixture meanwhile leads to disturbance of concrete continuity and thus creates a weak plane between the core and the concrete cover. Hence, PPVC modules cannot be built as a strong and durable assembly with the current PPVC connectors.

In contrast to the initial loading stage, the stress of the steel connector exceeds the proportional limit in a subsequent loading stage, and the Poisson's ratio of the concrete becomes greater than that of the steel. As a result, a lateral interactional force is generated for squeezing between the steel connector and the concrete. In other words, the steel connector constrains concrete transversal deformation. In this way, the PPVC connector can make two or more PPVC modules into a monolithic assembly in a quick manner by forming a continuous reinforced structure in-between the PPVC modules after curing the concrete. In addition, the PPVC connector is also convenient and efficient to be made off-site, transported to a construction site and used on-site. In contrast, it is very time-consuming to assemble traditional connectors that have many complimentary parts, such as a hole and a lock, a treaded bolt and a nut, or a male connecting member, a female connecting member and a pin. Moreover, the traditional connectors are relatively delicate and thus not suitable for application in civil construction.

The frame is configured to restrict, restrain, limit, confine, or prevent detachment, misalignment or relative movement between the first PPVC module and the second PPVC module, whether in a plane or in more than two Cartesian directions (e.g. lateral directions of the PPVC modules). The frame is alternatively known as a restrictor, a restrainer, a coupler, a firm connector or a linkage that stops or help stop departure of the two anchors or PPVC modules from each other. One or more parts of the PPVC connector are able to be integrally formed, or assembled by several components. For example, the first anchor and the frame are optionally in unitary form or snapped on, being convenient to deploy.

The first anchor and/or the second anchor optionally has a cross section of a rectangular shape (e.g. square). The shape of the cross section may be semi-rectangular, circular, semi-circular, oval, semi-oval, equilateral, cyclic, convex, concave, regular convex. The first anchor, the second anchor, the rigid or flexible frame or a combination of any of these components fold laterally for defining the cavity or the enclosure. The cavity has an opening that is narrower than an opposite side (known as base side) of the opening. As a result, the first anchor, the second anchor, the rigid or flexible frame form a unitary element with the filler and thus create the confinement effect. The rigid or flexible frame comprises one or more plates, one or more rods, or a combination of both rods and plates (e.g. a rod and a plate together as the frame). The one or more plates, rods or a combination of both can be configured to extend beyond one of the first and second PPVC module for connecting PPVC modules vertically. For example, the frame comprises multiple shafts, bars, rods, plates or sticks that are distributed over a height direction of the first or second PPVC modules. The first anchor, the second anchor, the frame or any of their combination comprises an uneven external surface. The PPVC connector (e.g. the first anchor, the second anchor and the frame) is made of material that is chemically inert to the filler. For example, one or more surfaces of the first anchor, the second anchor and/or the framer are roughened, perforated or both. The frame or rigid frame comprises at least two vertical elements (e.g. plates, rods or both) as the elongated poles extending along the cavity and at least one horizontal element as the shaft for combining the vertical elements. The one or both vertical elements are symmetrically arranged around the at least one horizontal element. The filler is grout, concrete or other curable material for adhering to the PPVC connector. For example, the concrete is filled, cured and retained in the cavity for forming a continuous reinforced structure after curing, providing confinement effect. In addition, the PPVC connector comprises at least one fastener.

The PPVC connector is usually designed for manufacturing in bulk, having all of its components packaged separately. Since the first anchor and the second anchor can be ingrained or planted into walls or other parts of PPVC modules respectively at predetermined locations according to specific orientations, the frame can be speedily, easily and securely installed at a building site where the two PPVC modules are aligned and next to each other. In fact, the anchors can even be used as guides or signposts for locating PPVC modules. Since the frame or the PPVC connector is able to tie or fasten PPVC modules together, a building with the PPVC modules become robust and sturdy, being able to withstand earthquake or other natural disasters over many years. Alternatively, the frame is optionally pre-fabricated offsite, then transported to a construction site as a whole and finally installed with the first anchor and the second anchor to form a monolithic structure of the PPVC modules. The pre-fabricated frame does not need to be installed onsite, which thus not only saves construction time but also eliminates potential environmental contamination. The latter advantage is particularly critical if the construction is conducted in a downtown area.

The first anchor, the second anchor and the frame are optionally or preferably made of a material that is chemically inert to the filler. In this way, the first anchor, the second anchor and the frame can keep a confined space during curing in order to make a continuous reinforced structure with the filler. For example, when concrete is adopted as the filler, the material is stainless steel or plastics that can chemically resist corrosion from a fluid cement before and during curing. In addition, concrete is strong in compression and thus is able to efficiently carry a compression load; However, a pure concrete structure is weak in tension and thus may crack with aging. The frame of the present application also helps form reinforced concrete as a continuous reinforced structure that supports the assembled PPVC modules durably.

The continuous reinforced structure is a mixture of the PPVC connector and the filler such as cement grout. On one hand, the structure has a high compressive strength and stiffness of the concrete such that the structure can support the PPVC modules in a longitudinal direction. On the other hand, the structure also has a high tensile strength and ductility of the steel to resist internal tension. As a result, the continuous reinforced structure is particularly suitable for high-rise buildings or even super high-rise buildings.

The first anchor, the second anchor and the frame can have a dimension (e.g. height or length) of more than 50 millimetres, 100 millimetres, 150 millimetres, 200 millimetres, 250 millimetres or extending throughout a height of the two PPVC modules substantially. For example, one or more pieces of the first anchor, the second anchor, the frame or other components of the PPVC connector comprises one or more plates, which has a dimension (e.g. height or length) of more than 50 millimetres, 100 millimetres, 150 millimetres, 200 millimetres, 250 millimetres or extending throughout a height of the two PPVC modules substantially. If the dimension or one dimension of the plate is substantially larger than other dimensions of the plate, the plate is also perceived as an elongated plate effectively. The plate is folded laterally for having multiple sides to be attached to the first PPVC module.

The first anchor comprises an elongated plate that may be folded with a single fold or multiple folds at an edge or middle (e.g. having a U-shaped profile) in a length and/or width directions, but not in a height direction of the PPVC modules or a longitudinal direction of the first anchor for providing a cavity by the first anchor or together with a wall of the PPVC modules. A cross section of the first anchor optionally has a square, a round or any other geometry shape or profiles, as projection of on a two dimensional surface (e.g. a plane), such as resembling profiles of pattern blocks. As an illustration, a hollow conduit formed by the first anchor or anchor is able to receive a cylinder with diameter of about 10 millimetres (mm), 15 millimetres, 23 millimetres, 38 millimetres, 50 millimetres or 60 millimetres substantially. Similar to the first anchor or simple anchor, the second anchor optionally comprises another elongated plate that is folded with a single fold or multiple folds for providing a cavity by the second anchor.

The plate may be sheet that can be folded laterally and attached to the PPVC module. Compared with the rigid plate, the sheet has a rather flexible nature that the sheet can be folded into various shapes such as a circular shape or any irregular shape for forming a substantially confined space. Preferably, the folded sheet has an uneven external surface such that the folded sheet can be firmly fixed within the PPVC module.

Furthermore, the first PPVC module, the second PPVC module and the frame can be formed by other methods for having multiple sides. For example, a moulding method may be adopted for making the PPVC module and/or the frame in a single process. Comparted with the procedure of folding the plate or the sheet, the moulding process save the time and cost of the additional folding procedure.

The frame optionally comprises a dumbbell coupler or dumbbell connector which comprises at least one shaft (e.g. rebar) with two opposite ends. One or both of the opposite ends has a larger cross section area than a cross section of the shaft between the two opposite ends. In use, one or both of the opposite ends are placed into cavities of the first anchor and the second anchor respectively so that the narrow openings of the first and second anchors prevent separation of the first and second anchor. Either one or both of the opposite ends of the dumbbell coupler comprises one or more elongated poles connected (e.g. welded) at one of the opposite ends for enlarging the opposite end. A longitudinal axis of the elongated pole is substantially perpendicular to a longitudinal axis of the shaft. In other words, the elongated poles are parallel but perpendicular to the shaft. Optionally, the elongated poles are symmetrically distributed around the dumbbell couplers for establishing a balanced structure. The elongated pole comprise a first elongated pole and a second elongated pole that are attached to opposite side of the at least one shaft. For example, a dumbbell coupler is located in the confined cavity in-between the PPVC modules with a first end within the first anchor and a second end within the second anchor. A first elongated pole is positioned within the first anchor and connected onto a left side of the first end of the dumbbell coupler; while a second elongated pole is located within the second anchor and connected onto a right side of the second end of the dumbbell coupler.

In another example, the frame may comprise and a dumbbell coupler and four elongated poles, i.e. a first elongated pole, a second elongated pole, a third elongated pole and a fourth elongated pole. The first and second elongated poles are located in the first anchor; while the third and fourth elongated poles are located in the second anchor. Specially, the frame still keeps a symmetrical arrangement of the elongated poles. The first and the second elongated poles are combined onto a left side and a right side of the first end of the dumbbell coupler respectively; while the third and fourth elongated poles are combined onto a left side and a right side of second end of the dumbbell coupler respectively.

One or more elongated pole (such as the first elongated pole, the second elongated pole or both) of the frame protrudes from the first anchor and/or the second anchor (or the second wall) for directing and temporally holding the second PPVC module to the first PPVC module when the second PPVC module is stacked onto the first PPVC module. The first anchor and the second anchor are designed to be aligned with each other when the second PPVC is stacked or mounted onto the first PPVC module. The protruding pole in one anchor (such as the first anchor) can be used for the alignment by extending protruding portion into another anchor (such as the second anchor). The protruding pole is preferably strong enough for temporally holding the two PPVC modules together in a stacked configuration until permanent fixing methods are conducted. For example, the first elongated pole protrudes from a top side of the first anchor of the first PPVC module and then extends into the second anchor of the second PPVC module from a bottom side of the second anchor. As a result, the first elongated pole of the first PPVC module is partially overlapped with the fourth elongated pole of the second PPVC module in the second anchor. For another example, the fourth elongated pole protrudes from the bottom side of the second anchor of the second PPVC module and then extends into the first anchor of the first PPVC module from the top side of the first anchor. As a result, the fourth elongated pole of the second PPVC module is partially overlapped with the first elongated pole of the first PPVC module in the first anchor.

One or more elongated bars (e.g. first bar & second bar parallel to each other) that are substantially parallel to the first anchor, the second anchor or the frame in the longitudinal directions. As a result, the two PPVC modules facing each other are additionally firmly coupled and lapped into a unitary building block.

For both of the examples above, the elongated poles can be solid bars, hollow tubes or both, according to a specific architecture. For example, solid bars are adopted if the assembly of the PPVC modules is required for a superior compression property. Instead, hollow tubes can be used as water pipes for a specific location of the building such as a bathroom or a kitchen. Or the elongated poles can be a mixture of the solid bars and the hollow tubes for having both of the functions. Similarly, the dumbbell coupler can also be a solid bar or a hollow tube according to a specific architecture.

As described above, the dumbbell coupler combines the elongated poles together to form a right frame. Different methods can be adopted according to the specific materials. For example, when the dumbbell coupler and the elongated poles are made of stainless steel, they can be combined by welding. In addition, a rope or the alike may also be used for tying the elongated poles together with the dumbbell coupler.

One or more pieces of the first anchor, the second anchor and the frame are optionally corrugated, roughened or checked (e.g. having a continuous or repeated pattern of squares or other regular shapes) for capturing fillers such as grout, cement or other types of fillers. If a component piece or part of the PPVC connector (e.g. anchor or frame) is made of a plate, the plate is possibly punctured, roughened or surface treated (e.g. coated, sandblasted) that is able to keep the grout or concrete better than a smooth or polished surface.

One example of corrugation includes regular patterns or repeated formations on the one or more pieces of the first anchor, the second anchor and the frame. A distance between two neighbouring or close perforations is about 10 millimetres, 18 millimetres, 27 millimetres, 36 millimetres, 50 millimetres, 68 millimetres or 72 millimetres substantially. The component, piece or part is optionally further attached (e.g. welded) with other thin structure for improving surface adhesion, including woven & welded wire mesh.

One or more components, pieces or parts of the first anchor, the second anchor and the frame are sometimes perforated for passing grout through perforations on the first anchor, the second anchor or the frame. Since one or more fillers (including grout) are slurry before curing, hardening or solidification, the one or more fillers are capable of flowing through the perforations in order to fill cavity of the first anchor, the second anchor, both anchors or the PPVC connector, whether alone or together with one or more PPVC modules. If the perforations are substantially similar, each similar perforation sometimes has an outer diameter of 8 millimetres, 16 millimetres, 20 millimetres, 28 millimetres or 36 millimetres substantially.

Preferably, one or more of the first anchor, the second anchor and the frame have a thickness or diameter of three (03), four (04), six (06), eight (08) millimetres substantially. Rods or plates of these parts that are made of steel or steel alloy are able to be manufactured in large quantity at low cost and high quality.

In some cases, The frame comprises a first coupler (e.g. made by the plate) having two wings that are spaced apart for providing a receptacle in order to receive or enclose portions of the first anchor and the second anchor. The frame further comprises a second coupler having two wings that are spaced apart for receiving portions of the first anchor and the second anchor. The two wings possibly face each other in forming a cavity, resembling a "C" or "U" shape for receiving one or more edges (e.g. two edges) of the first anchor and the second anchor respectively. The two projected parts (e.g. known as prongs) are able to kept protruded parts of the anchors inside the cavity, which locks the two anchors and their respective PPVC modules together.

In some instances, the frame further comprises a second coupler having two wings, extensions or prongs that are spaced apart for receiving portions (such as edges or extensions) of the first anchor and the second anchor. The two couplers of the frame are able to hold the two anchors from opposite or multiple sides or directions, improving strength of the joint between the two PPVC modules. In addition, the frame further comprises a rib (e.g. a plate, rebar or rod) that joins the first coupler and the second coupler together. The rib is an elongated plate or long raised piece for strengthening or supporting the couplers. The frame comprises one or more rods for inserting into the first coupler and/or the second coupler in order to join the first PPVC module and the second PPVC module together. In addition, the plate, the anchors, the couplers, the rib, the frame or a combination of any of these are perforated for receiving the filler, and also corrugated, and/or roughened for fixing with the filler more firmly.

The frame comprises at least one rod for joining the first PPVC module and the second PPVC module together. For example, the first anchor can comprise a first bar (also known as, rod, rebar or reinforcing bar) and a second bar that are spaced apart from each other. Similarly, the second anchor comprises a bar and another bar that are also spaced apart from each other. The first bar or second bar is operable to extend along a longitudinal direction of any of the anchors, and/or parallel to a height or vertical direction of any of the PPVC modules. A PPVC module is a building unit, including a living unit, a bathroom unit, a storeroom unit or a sitting room unit, which are capable of being joined, assembled or stacked to complete a building or a, integral part of the building.

The present application further provides an assembly or building assembly of PPVC modules (e.g. a multistorey building) that comprises a first PPVC module, a second PPVC module and possibly other PPVC modules. The first anchor of the PPVC connector is attached or embedded to the first PPVC module, whilst the second anchor of the same PPVC connector is attached or embedded to the second PPVC module. The first PPVC module and the second PPVC module are sometimes laterally assembled together, being neighbouring to each other. The assembly or building assembly becomes a unitary body when a filler is filled at or inside the PPVC connector. The filler can join the first PPVC module and the second PPVC module together by a confinement effect, because the PPVC connector securely directs the two PPVC modules together for forming a confined cavity, whether temporarily or permanently. One or more of the assemblies are further capable of being stacked, preferably by aligning stacked PPVC modules along their respective walls. In fact, the PPVC connector is further possible protrude above a PPVC module for aligning a top PPVC module. For example, the PPVC connector has a cavity to receive a bar or dowel bar that passes through two longitudinally aligned PPVC connectors in their cavities. The filler comprises fills cavities formed by the first anchor, the second anchor, the frame or a combination of any of these. As a result, the PPVC modules are coupled into a unitary building block by the filler and the PPVC connector.

In either of the laterally assembled or the stacked PPVC modules, the filler becomes a continuous reinforced structure after curing in-between the first PPVC module and the second PPVC module for joining and supporting the assembly of PPVC modules. More specially, the continuous reinforced filler is imaginarily divided into basically two parts, comprising a first part located in the first anchor of the first PPVC module and a second part located in the second anchor of the second PPVC module. In this case, the first PPVC module and the second PPVC module are substantially in a close contact and no gap exists at the interface. In another case when there is a space at the interface between the two PPVC connectors, the reinforced filler may further comprise a third part located between the first PPVC module and the second PPVC module for connecting the first part and the second part of the reinforced filler. In both cases, the assembly of the PPVC modules becomes a monolithic structure due to the continuous reinforced structure of the filler.

In addition to the filler, the assembly of PPVC modules can further comprise a binder (e.g. filler or same type of material as the filler), an adhesive, a sealant and/or a binder for binding walls of the first PPVC module and the second PPVC module together in a laterally manner. The binder fills cavities formed by the first anchor, the second anchor, the frame or a combination of any of these parts or components, whether fully, partially, progressively or instantaneously. Together with the filler, the adhesive and/or the binder not only expel air from the cavities, but also assists unite the parts (e.g. the PPVC connector and PPVC modules) integrally. It is often desirable that the PPVC connector, the filler, the adhesive, the sealant and/or the binder is water resistant, fireproof, fire retardant, shockproof, pest resistant, corrosion resistant, weatherproof, wear resistant, or having a combination of any of these characteristics.

The first anchor and the second anchor may be aligned (e.g. face each other with openings of their cavities) for receiving the frame or an opposite piece (e.g. an anchor). Since the PPVC connector may be mass produced, a building constructor or worker is easy to identify matching pieces of anchors on different PPVC modules for matching.

One or more cavities are optionally formed by the first anchor, the second anchor and the frame extends substantially over an entire height of any of the PPVC modules. The PPVC connector are optionally configured to extend over an entire height or a portion of a PPVC module. For example, two PPVC connector extend throughout the entire height of two neighbouring PPVC modules, whilst another PPVC connector extends only a portion of the height in the middle of the two joining PPVC modules. In this way, the two PPVC module are constructed as a monolith stacked assembly that cannot be split-up due to the confined and cured filler.

A stacked assembly of PPVC modules can also be made, comprising a first PPVC module, a second PPVC module, a third PPVC module attached to the first PPVC module vertically (i.e. the third PPVC module is stacked on top of the first PPVC module). The first PPVC module and the third PPVC module share at least a portion of the PPVC connector described above. The PPVC connector comprises a frame that extends to both the first PPVC module and the third PPVC module. More specially, the frame comprises a first portion protruding from a top surface of the first PPVC module and a second portion staying inside the first PPVC module. The first portion extends into the second PPVC module from the bottom surface. As a result, the frame guides the alignment of the second PPVC module on the first PPVC module, and temporarily or permanently fix the assembly as a whole before and during the curing process.

The stacked assembly of PPVC modules optionally comprises a filler in the PPVC connector for joining the first PPVC module, the second PPVC module and the third PPVC module by confinement effect. After curing, a reinforced filler is formed in the first and second PPVC modules. The reinforced filler is a unitary or continuous structure for combining and supporting the stacked assembly of PPVC modules.

The PPVC connector is sometimes submerged substantially into or below a surface (e.g. buried inside) of a wall of one of the PPVC modules, whether fully or partially. Hence, one or more parts of the PPVC connector (e.g. first anchor) becomes integrally joined to a PPVC module, which provides a strong linkage for coupling two PPVC modules together. The PPVC connector possibly offers an unbreakable, shatterproof or adamant connexion, which ensures integrity of the building assembly.

Embodiments of the assembly of PPVC modules comprises a first PPVC connector and a second PPVC connector, which are substantially identical or similar to the PPVC connector. The first PPVC connector and the second PPVC connector are attached or embedded to the same wall of any of the PPVC modules. Accordingly, a single PPVC module has multiple pieces of PPVC connectors or anchors for joining another PPVC module. The multiple pieces of PPVC connector is possible to confine, reduce, eliminate or obviate misalignment or detachment of two connected PPVC modules.

The first PPVC module and the second PPVC module are preferably spaced apart from each other with an even gap in-between for infilling by grout or filler. Instead of having hard walls of two neighbouring PPVC modules being pushed against each other, the filler such as non-shrink grout or cement provides a "glue" and "cushion", which can be used to adjust distance between two neighbouring PPVC modules, whether laterally or vertically. The filler after curing forms a continuous reinforced structure due to the confinement effect of the gap in-between the two PPVC modules. Multiple, additional or other types of connectors are optionally installed between two laterally or vertically neighbouring PPVC modules in order to fasten the two PPVC modules together. These PPVC connectors are optionally further connected or inter-locked to each other for secure and resilient fastening, such as against earthquake.

In some cases, the assembly of PPVC module further comprises a third PPVC module that is stacked on any of the PPVC modules. Two stacked PPVC modules are optionally aligned vertically by one or more bars or dowel bars, which sometimes are inserted into a PPVC connector or anchor. A single bar or dowel bar is optionally inserted into multiple PPVC connectors or anchors, which are aligned vertically in order to provide a straight cavity. For instance, a bar, a rebar or a dowel bar is enclosed by the first anchor. The bar, rebar or dowel bar is subsequently casted into the anchor or PPVC connector by grout, cement or any other adhesive, providing excellent bonding between PPVC modules.

According to another aspect, the present application provides a method for using a PPVC connector. The method comprises a step of attaching a first plate of a first anchor to a first PPVC module permanently, such as by mortar or adhesive; a step of attaching a second plate of a second anchor to a second PPVC module; a step of aligning the first PPVC module and the second PPVC module in order to provide a cavity between the first plate and the second plate; and step of coupling the first anchor and the second anchor together by a frame in order to prevent detachment between the first PPVC module and the second PPVC module (by filling the cavity with a filler in order to provide confinement effect. Some of these steps can be combined, divided or changed in sequence. For example, the second anchor is firstly attached to the wall of the second PPVC module. The present method provides a simple, reliable and low cost of securing two PPVC modules together.

The step of coupling the first anchor and the second anchor further comprises installing a first coupler for providing a receptacle in order to receive portions of the first anchor and the second anchor. The first anchor has a size that is large enough to prevent detachment of the first and the second PPVC modules by in a lateral direction. The step of coupling the first anchor and the second anchor may further comprise installing a second coupler for providing a receptacle in order to receive portions of the first anchor and the second anchor. The second coupler has a similar function as the first coupler but works independently.

The method can further comprise a step of filling the cavity between the first anchor, the second anchor and the frame with a filler (e.g. adhesive, grout). The filler not only can optionally glue the two PPVC modules together, but also can be used to adjust distance between the two adjoining PPVC modules. In some circumstances, the filler is resistive to water penetration, pest, corrosion, shrinkage or any other impairment.

The method optionally further comprises providing a binder between walls of the first and second PPVC modules. According to specific chemical and/or physical nature, the binder can be added before, together with, or after filling the gap with the filler. In addition to the binder, other chemical admixtures can also be added, including accelerators, retarders, air entraining agents, plasticizers, pigments and corrosion inhibitors.

The method of may additionally comprise a step of bonding the first PPVC module and the second PPVC module together by curing the filler. When applied, the filler is sometimes a fluidic or slurry form, being easy to flow or entering gaps. Once cured, whether by air, heat or automatically over a predetermined period of time, the filler is able to seal any shape or size of gap, being flexible and reliable for infilling. The filler will create confinement effect between the first anchor and the second anchor by using the frame, and increase bond and tie force between the connected PPVC modules during a loading stage. The method may further comprise removing extra filler flowing out of the assembled PPVC modules after curing. The extra filler does not form a continuous structure with the reinforced filler since the extra filler is not confined within the in-between cavity of the anchors.

The method may further comprise a step of attaching a third plate of a third anchor to a third PPVC module; a step of putting the third PPVC module on top of the first PPVC module in order to line-up the third plate with the first plate; and a step of extending at least a portion of the frame from the first plate to the third plate. As a result, the first anchor and the third anchor form a cavity that extends throughout the longitudinal length of the first and third PPVC modules. The method further comprises filling along the second anchor and the first anchor with a filler from top to bottom. The filler is confined in the throughout cavity and then cured to form a continuous reinforced structure that prevents detachment of the stacked assembly. Alternatively, the filler packed a cavity between the first PPVC module, the second PPVC module and the third PPVC module either at the PPVC connector or between their walls, ceiling or floors.

According to a further aspect, the present application provides a method for making a PPVC connector. The method comprises a step of providing a first plate; a step of folding the plate laterally in order to provide a cavity of a first anchor; a step of providing a second plate; a step of folding the second plate in order to provide another cavity of a second anchor; a step of presenting, offering or providing a frame for joining and aligning the first anchor and the second anchor at their cavities. Some of these steps can be combined, divided or changed in sequence. For example, the third step of folding the plate optionally precedes the previous the second step of corrugating the plate. Parts of the PPVC connectors are able to be manufactured easily at low cost. The method may further comprise a step of corrugating, perforating or deforming the first plate, the second plate or both for improving surface adhesion of the plates.

The method can further comprise a step of offering a frame for coupling the plate with another anchor together. The frame is able to prevent or reduce movement of the two anchors or two adjoining PPVC modules from detachment, which typically move in a plane or two dimensional according to a Cartesian coordinate system. Put differently, under a cylindrical coordinate system, the frame is able to delimit, restrict, restrain or prevent respective movement between two adjoining PPVC modules in its cylindrical axis, especially confining radial movement of the cylindrical coordinate system. The step of offering a frame optionally comprises providing a coupler as the frame for receiving portions of the first anchor, the second anchor or both.

The step of presenting the frame optionally comprises providing a dumbbell coupler. The step of providing the dumbbell coupler optionally comprises attaching opposite ends of at least one shaft with a first elongated pole and a second elongated pole respectively. The first and second elongated poles are perpendicular to the shaft. The step of providing a dumbbell coupler optionally comprises a single end of the at least one shaft with two poles at opposite sides of the single end. The method further comprises a step of attaching multiple shafts along the first elongated pole, the second elongated pole or both. The method further comprises making a plurality of perforations on the first plate, the second plate or both, either before or after folding the plate.

Optionally, the method for making another PPVC connector is also applicable to the flexible sheet as the plate. The method comprises a first step of providing a sheet for attaching to a first PPVC module as an anchor; a second step of corrugating the sheet for improving surface adhesion of the sheet; a third step of folding the sheet for fitting the contour of the first PPVC module; and a fourth step of providing a cavity at the sheet for receiving a filler in order to create confinement effect. Compared with the plate in the former method, the sheet here is flexible enough for filing the contour of the PPVC module such that this method may be applicable to more customized designs.

The method further comprises providing a frame for coupling the flexible sheet as an anchor with another anchor together. Specially, the step of providing a frame further comprises combining two or more elongated poles with a dumbbell coupler for preventing detachment of the PPVC modules. More specially, the step of combining the elongated poles with a dumbbell coupler optionally comprises welding the elongated poles to the dumbbell coupler. In addition, the method may also comprise providing a fastener for combining the elongated poles with the dumbbell coupler.

The accompanying figures (Figs.) illustrate embodiments and serve to explain principles of the disclosed embodiments. It is to be understood, however, that these figures are presented for purposes of illustration only, and not for defining limits of relevant applications.

Figure 1:
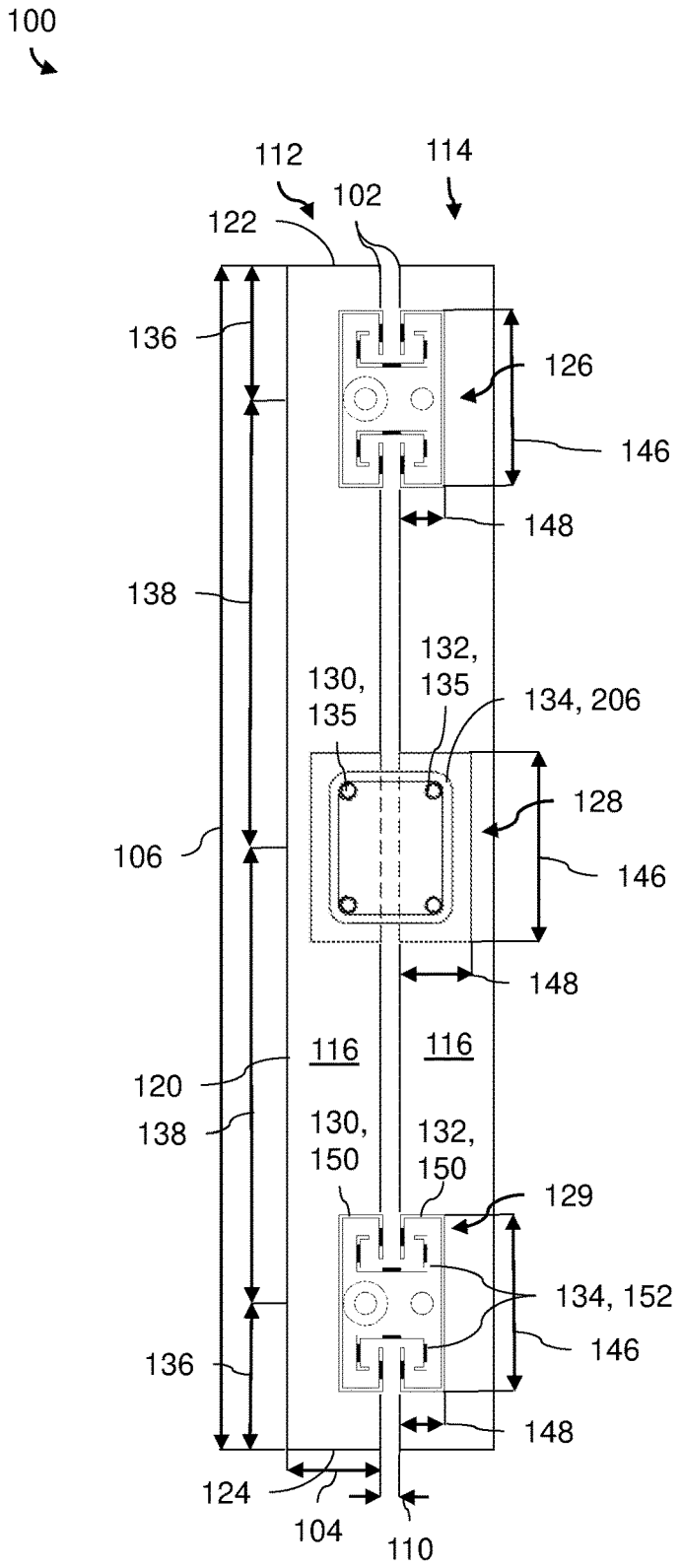
FIG. 1 illustrates a plan of two facing walls with an assembly of a first embodiment.

FIG. 1 to FIG. 7 show a first embodiment of the present application. FIG. 1 illustrates a plan of two facing walls with an assembly 100. The plan of two similar walls arranged side by side along an adjoining long face 102 with a wall breadth 104 of about one hundred millimetres (100 mm), a wall length 106 of about one thousand two hundred millimetres (1,200 mm) and a wall height 108 of about three thousand one hundred and fifty millimetres (3,150 mm) (not shown in FIG. 1). A grating gap 110 of about 20 mm separates the two walls.

The assembly comprises a PPVC (Prefabricated Prefinished Volumetric Construction) connector for coupling a first PPVC module 208 and a second PPVC module 210. The PPVC module 208 or 210 comprises walls, floors and ceilings which are constructed and assembled at an offsite fabrication facility. This PPVC module 208, or 210 is then transported and installed in a building under building works. In the following description, the connector for walls are described in detail; coupling two walls side by side at one face and coupling two walls by stacking one on top of the other at another face.

In this embodiment, the first PPVC 208 has a first wall 112; while the second PPVC 210 has a second wall 114. The first wall 112 or the second wall 114 has six faces each. The top outer surface of the first wall 112 and the second wall 114 is known as a first top face 116 and a second top face 117 respectively. An opposite face of the first top face 116 is a first bottom face 118 which is not shown in FIG. 1. An opposite face of the first adjoining long face 102 is a first opposite long face 120. A first primary side face 122 is a narrow face that meets the first adjoining long face 102 with the first opposite long face 120 and the first top face 116 with the first bottom face 118. Opposite the first primary side face 122 is a first secondary side face 124. The term "opposite" is used to describe a distal side or a far side across a proximal side.

There are three assemblies as seen on the first top face 116 of the first wall 112 comprising a first assembly 126, a second assembly 128 and a third assembly 129. The second assembly 128 is interposed between the first assembly 126 and the third assembly 129. Each assembly 126,128,129 comprises an at least one anchor and a restrictor 134. Further details of each assembly 126,128,129 will be described subsequently. The restrictor 134 is also known as a restrainer or a frame.

A first anchor 130 is secured to the first wall 112 whilst a second anchor 132 is secured to the second wall 114. The restrictor 134 encloses the first anchor 130 and the second anchor 132 in other words, the restrictor 134 brings the two anchors 130,132 together which further holds the two walls 112,114 together.

The first assembly 126 proximal to the first primary side face 122 has a first assembly-to-side distance 136 of two hundred millimetres (200 mm). The first assembly-to-side distance 136 is measured from the first primary side face 122 to a centre of the first assembly 126 proximal to the first primary side face 122 or from the first secondary side face 124 to a centre of the third assembly 129 proximal to the first secondary side face 124. A first-to-second assembly distance 138 is four hundred millimetres (400 mm) as measured from the centre of the first assembly 126 to the centre of the second assembly 128.

Figure 4:
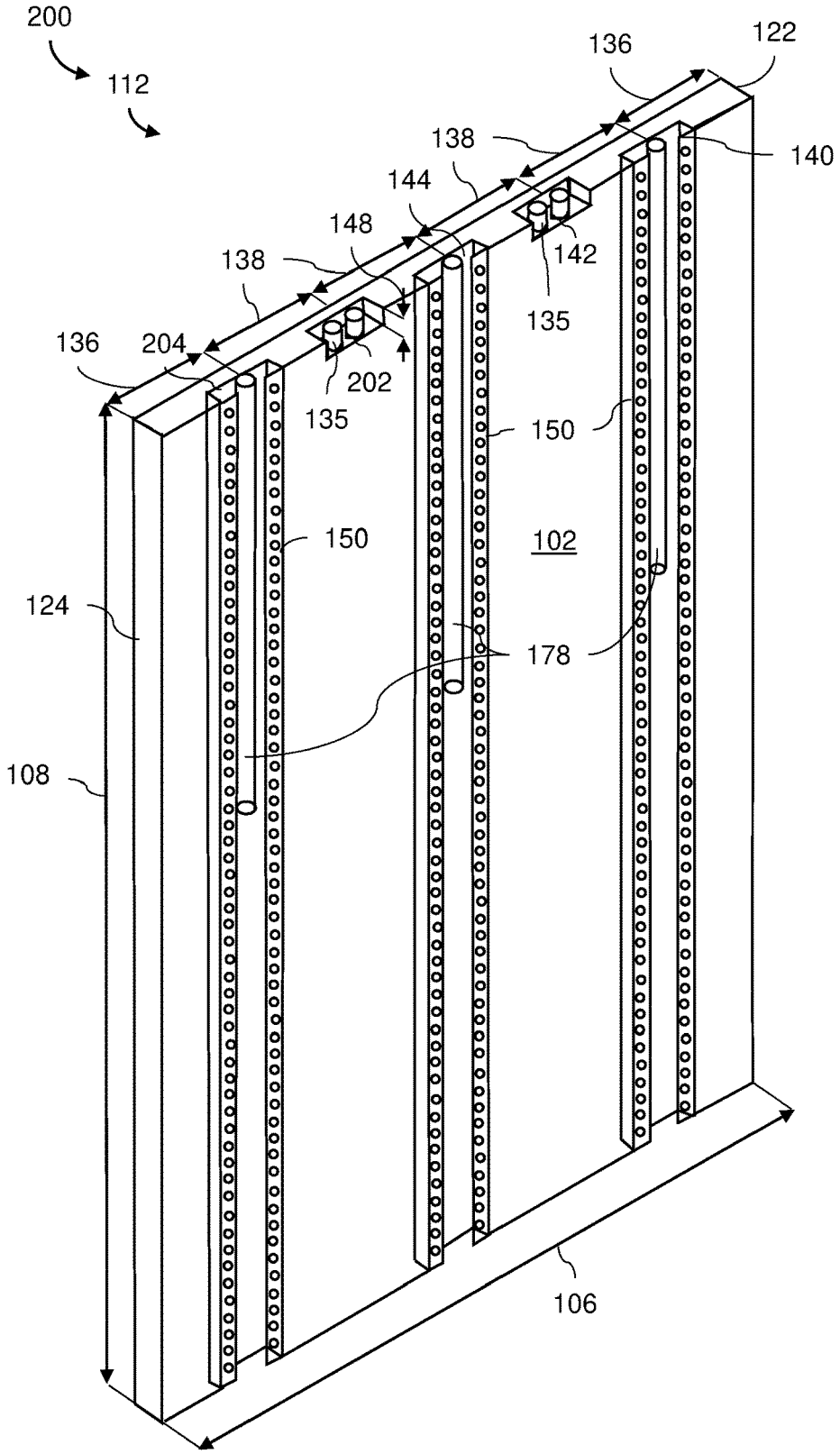
FIG. 4 illustrates a perspective of an inner face of a first wall having five indentations of a first embodiment.

The first wall 112 has three indentations 140,142,144 on the adjoining long face 102 which is clearly shown in FIG. 4. A first indentation 140 is proximal to the first primary side face 122. A second indentation 142 is at the centre of the first wall 112. A third indentation 144 is proximal to the first secondary side face 124 of the first wall 112. The first indentation 140 has an indentation depth 148 of fifty millimetres (50 mm) and an indentation breadth 146 of two hundred millimetres (200 mm). The first indentation 140 and the third indentation 144 have similar dimensions. The second indentation 142 has an indentation depth 148 of seventy-five millimetres (75 mm) and an indentation breadth 146 of two hundred millimetres (200 mm). Notably, the second indentation 142 has a deeper indentation i.e. deeper into the wall.

The first assembly 126, the second assembly 128 and the third assembly 129 as mentioned comprises the first anchor 130, the second anchor 132 and the restrictor 134. In the case of the first assembly 126, the first anchor 130 is a C-shaped anchor which is known as C-channel 150 whilst the first anchor 130 of the second assembly 128 is a shear bar 135 embedded in the first wall 112 in an erected position exposing a top section at the first top face 116. There are two shear bars 135 embedded in each second indentation 142 of each wall 112,114. The anchor is used to describe a device being secured to a fixed structure such as the wall.

The restrictor 134 of the first assembly 126 also has a C-shaped profile which is known as the lipped C-channel 152 is smaller in size compare to the anchor 130,132 or the C-channels 150. The restrictor 134 of the second assembly 128 has a square profile with four rounded corners circumscribing the two first anchors 130 and the two second anchors 132. The restrictor 134 used in the second assembly 128 is also known as a roof slab connector 206. The restrictor 134 is used to describe a connector that connects or binds more than one anchor 130,132 together.

Noting in the first assembly 126 there are black markings. The black markings denote perforations along the first anchors 130 and the second anchors 132 specifically for the first assembly 126 which are not shown in FIG. 1. From the plan, the first anchors 130 and the second anchors 132 have perforations at two flanks. The restrictor 134 in the first assembly 126 has perforations at a long side and two short sides. The two short sides flanking from the long side. The black markings or the perforation has an outer diameter of twenty millimetres (20 mm).

Figure 2:
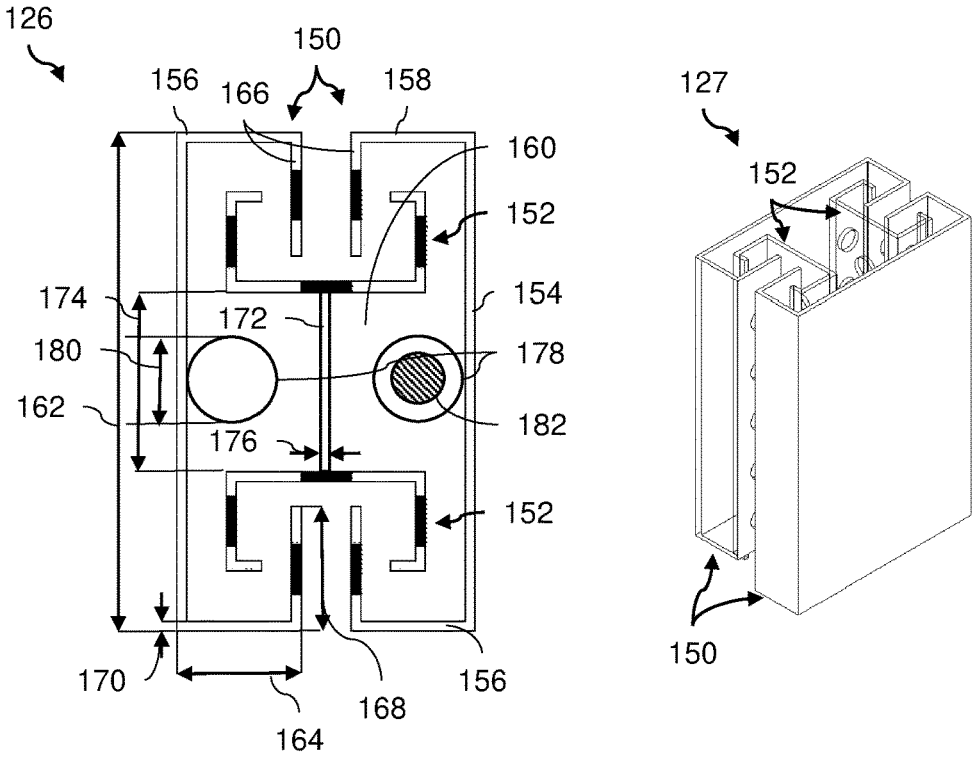
FIG. 2 illustrates a plan and a perspective of the assembly for coupling the two facing walls of a first embodiment.

FIG. 2 illustrates a plan and a perspective of the first assembly 126 for coupling the two facing walls. The first assembly 126 comprises the C-channel 150 (anchor 130) and the lipped C-channel 152 (restrictor 134). The C-channel 150 is also known as CC1 and the lipped C-channel 152 is also known as CC2. The walls are not shown in FIG. 2.

The C-channel 150 comprises a base portion 154, a right portion 156 and a left portion 158. The right portion 156 and the left portion 158 flanking on each end of the base portion 154. The right portion 156 and the left portion 158 further extends over the base portion 154 forming an overhanging extension 166 to form an open portion 160. Interposed between the open portions 160 of the two C-channel 150 is a corrugated pipe 178. The corrugated pipe has a pipe diameter 180 of fifty millimetres (50 mm). Inserted in the corrugated pipe 178 at the right open portion 160 is a dowel bar 182 as shown by a shaded circle.

The base portion 154 has a base breadth 162 of two hundred millimetres (200 mm). The right portion 156 and the left portion 158 has a side portion depth 164 of fifty millimetres (50 mm). The overhanging extension length 168 over the base portion 154 measures fifty millimetres (50 mm) on each side. A C-channel thickness 170 measures four millimetres (04 mm).

The restrictor 134 of FIG. 2 is formed by having the two lipped C-channel 152 joined together at a middle section by a rebar 172 as shown in FIG. 2. The lipped C-channel 152 also has a similar profile to the C-channel 150 but smaller in size as seen from the plan. Three rebar 172 are used to join the two lipped C-channel 152 specifically along a lipped C-channel length 174 of the lipped C-channel 152. The lipped C-channel length 184 measures three thousand one hundred and fifty millimetres (3,150 mm) which is similar to the wall height 108. Each rebar has a rebar length 174 of seventy-two millimetres (72 mm) with a rebar diameter 176 of six millimetres (06 mm).

In the perspective of the first assembly 127 of FIG. 2, the three rebar 172 are not seen. The three rebar 172 are positioned along the lipped C-channel length 184 specifically at one thousand and fifty millimetres (1,050 mm) interval between each rebar 172. A partial view of the perforations is seen on the overhanging extensions 166 of the C-channel 150. A partial view of the perforations is also seen on the lipped C-channel 152.

Figure 3:
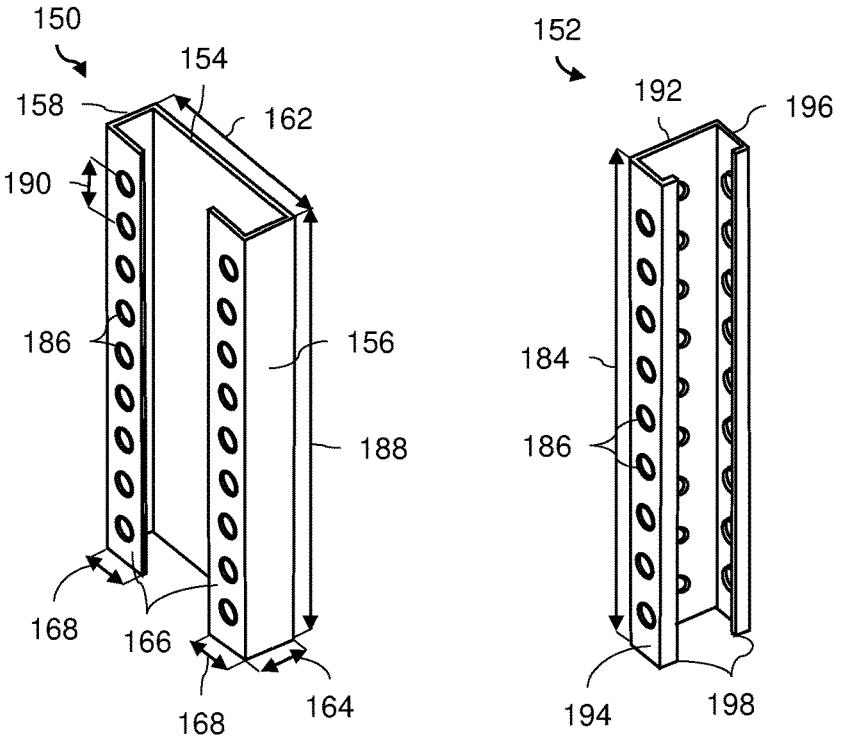
FIG. 3 illustrates a perspective of a C-channel and a lipped C-channel of a first embodiment.

FIG. 3 illustrates a perspective of the C-channel 150 and the lipped C-channel 152. The C-channel 150 is shown on the left hand side and the lipped C-channel 152 is shown on the right hand side.

The C-channel 150 having the right portion 156 and the left portion 158 flank on the two edges of the base portion 154. Concentric holes 186 are formed on the overhanging extensions 166 on the right portion 156 and the left portion 158. The diameter of each concentric hole 186 is twenty millimetres (20 mm). There are nine concentric holes 186 which are equally distributed along a C-channel extension length 188 of the overhanging extension 166. A concentric hole gap 190 between two concentric holes 186 is three hundred and fifty millimetres (350 mm).

The lipped C-channel 152 comprises a lipped base portion 192, a lipped right portion 194, a lipped left portion 196 and a lipped overhanging portion 198. Similar to the C-channel 150, the lipped C-channel 152 has a similar profile but smaller. The lipped base portion 192 measures eighty millimetres (80 mm). The lipped right portion 194 and the lipped left portion 196 measures forty millimetres (40 mm) each. The lipped overhanging portion 198 measures fourteen millimetres (14 mm). The lipped C-channel has a lipped C-channel thickness of four millimetres (04 mm). There are nine concentric holes 186 each on the lipped right portion 194, the lipped left portion 196 and the lipped base portion 192. The concentric holes 186 are equally spaced along a length of the lipped C-channel 152.

The C-channel extension length 188, the lipped C-channel length 184 and the wall height 108 all has the same measurement of three thousand one hundred and fifty millimetres (3,150 mm). The concentric holes 186 that are on the C-channel 150 and the lipped C-channel are representations. There are more than nine concentric holes 186 in reality.

FIG. 4 illustrates a perspective of the first adjoining long face 102 of a first wall 112 having five indentations. The first indentation 140, the third indentation 144 and a fifth indentation 204 has a C-channel 150 embedded therein. The first indentation 140, the third indentation 144 and the fifth indentation 204 extends along the height of the first wall 112 which has a wall height 108 measuring three thousand one hundred and fifty millimetres (3,150 mm). A corrugated pipe 178 is joined to the C-channel 150 lengthwise specifically at the centre of the base portion 154 in the first indentation 140, the third indentation 144 and the fifth indentation 204. The length of each corrugated pipe 178 is eight hundred millimetres (800 mm).

The first indentation 140 is positioned at a first assembly-to-side distance 136 of two hundred millimetres (200 mm) from the first side face 122. This same measurement applies from the second side face 124 to the fifth indentation 204.

The first-to-second assembly distance 138 of four hundred millimetres (400 mm) applies between indentations; the first indentation 140 to the second indentation 142, from the second indentation 142 to the third indentation 144, from the third indentation 144 to the fourth indentation 202 and from the fourth indentation 202 to the fifth indentation 204. The wall length 106 measures two thousand millimetres (2,000 mm) in total. The second indentation 142 and the fourth indentation 202 has two vertical shear bars 135 embedded therein. The second indentation 142 and the fourth indentation 202 has an indentation depth 148 of 75 mm which means 75 mm of the shear bars 135 are exposed.

Figure 5:
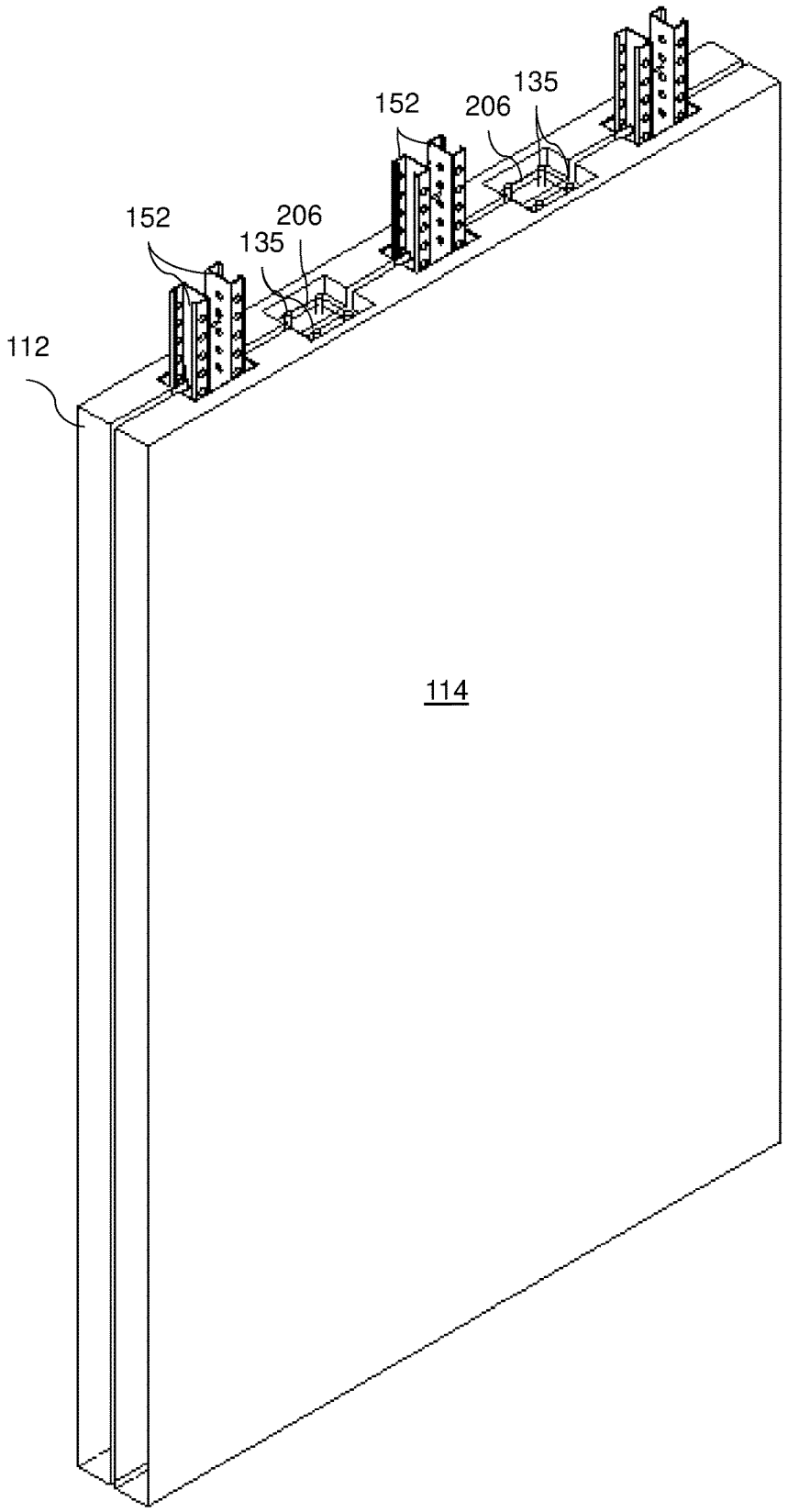
FIG. 5 illustrates a perspective of two facing walls with the assembly of a first embodiment.

FIG. 5 illustrates a perspective of two facing walls 112, 114 with the assemblies 126,128. Two similar walls are positioned in which the adjoining long faces 102 are facing each other. The first indentation 140 of the first wall 112 meets the fifth indentation 204 of the second wall 114. The second indentation 142 of the first wall 112 meets the fourth indentation 202 of the second wall 114. The third indentation 144 of the first wall 112 meets the third indentation 144 of the second wall 114. The fourth indentation 202 of the first wall 112 meets the second indentation 142 of the second wall 114. The fifth indentation 204 of the first wall 112 meets the first indentation 140 of the second wall 114.

Two lipped C-channel 152 are inserted into the two adjoining C-channels 150 in the first indentation 140, the third indentation 144 and the fifth indentation 204. The lipped C-channel 152 is positioned orthogonally with respect to the C-channel 150 before inserting in the two C-channels 150. The overhanging extension 166 of the C-channel 150 and the lipped overhanging portion 198 of the lipped C-channel 152 are communicatively engaged. Over at the second indentation 142 and the fourth indentation 202 a roof slab connector 206 is communicatively engaged with the two shear bars 135 of the first wall 112 and the two shear bars 135 of the second wall 114.

The lipped C-channel 152 is protruded over the first top face 116 and the second top face 117 of the two walls 112,114. The protrusion measures two hundred and forty-five millimetres (245 mm) measured from the top face 116,117 to the apex of the lipped C-channel 152.

Figure 6:
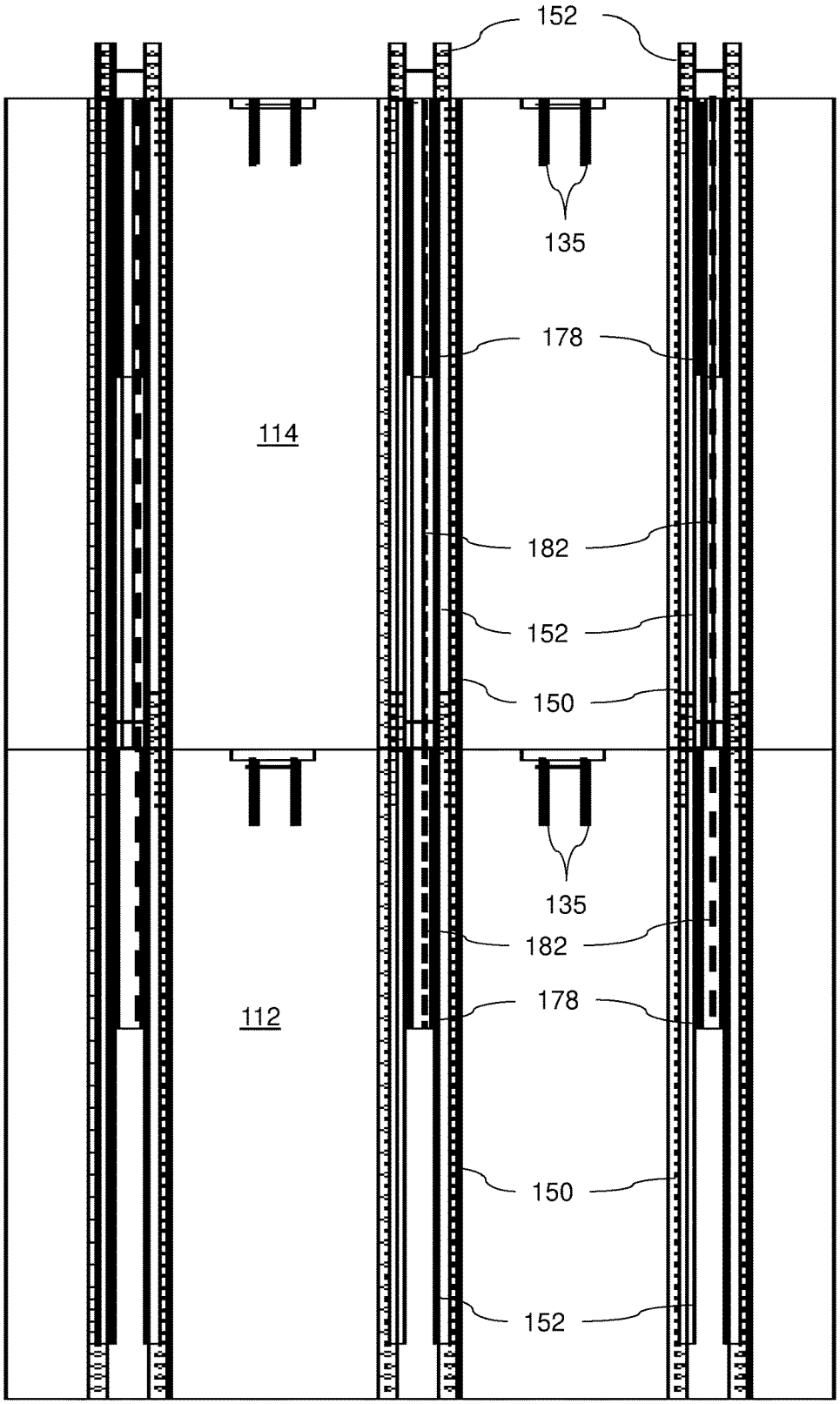
FIG. 6 illustrates a side view of two walls stack on top of each other of a first embodiment.

FIG. 6 illustrates a side view of two walls 112,114 stack on each other specifically the second wall 114 is on top of the first wall 112. The lipped C-channel 152 protruded from the top face 116 of the first wall 112 extends into the bottom of the C-channel 150 of the second wall 114. The lipped C-channels 152 of the second wall 114 protrudes out from the second top face 117 of the second wall 114. The corrugated pipes 178 are in between the C-channels 150. The dowel bars 182 are within the corrugated pipes 178 which extends from the second top face 117 of the second wall 114 to the end of the corrugated pipes 178 inside the first wall 112.

Figure 7:
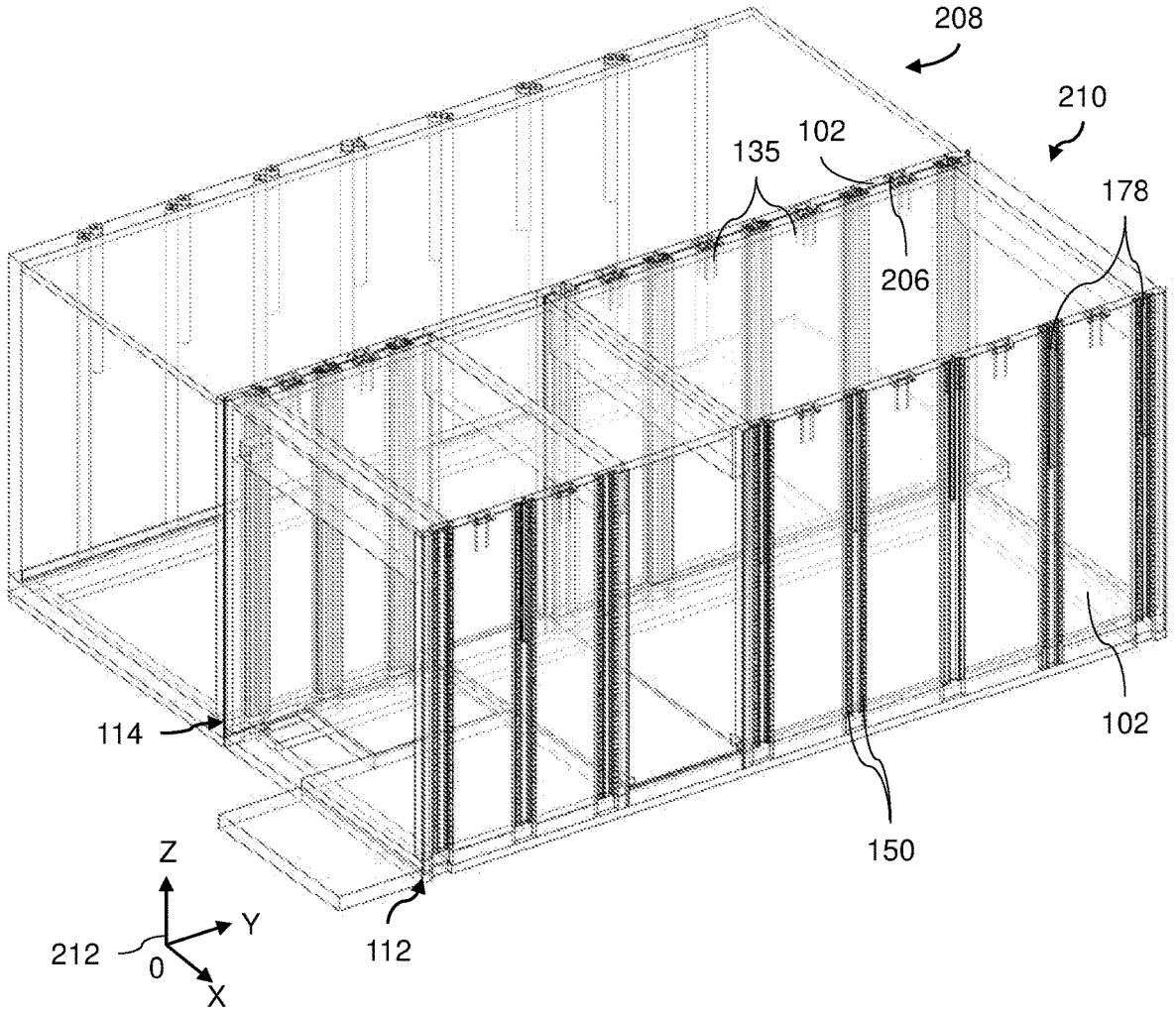
FIG. 7 illustrates a perspective of two PPVC modules joined at an adjoining long face of a first embodiment.

FIG. 7 illustrates a perspective of two PPVC modules 208 joined at an adjoining long face 102. The first PPVC module 208 is a terminating PPVC module which has PPVC connectors only on one side thereof. The second PPVC module 210 has PPVC connectors on the two adjoining long faces 102 thereof. The PPVC connectors comprise first, the C-channel 150 acts as the anchor and the lipped C-channel 152 which acts as the coupler; and second the shear bars 135 which act as the anchor and the roof slab connector 206 acts as the coupler.

The second PPVC module 210 has an exposed adjoining long face 102 revealing the eight long indentations that extends from the top face 116 to the bottom face 118 thereof. The exposed adjoining long face 102 corresponds to the first wall 112 as shown in FIG. 4. Each of the eight indentations have a pair of C-channels 150 embedded. The two C-channels 150 are embedded within and along the indentation and facing each other.

The roof slab connector 206 is a bar formed into a square with rounded corners. The first PPVC module 208 and the second PPVC module 210 are coupled by placing the roof slab connector 206 into the two exposed shear bars 135 of the first PPVC module 208 and into the remaining two shear bars 135 of the second PPVC module 210. The roof slab connector 206 circumscribing the four shear bars 135. There are six short indentations on the exposed adjoining long face 102. Each short indentation is interposed between two long indentations. Each short indentation has two shear bars 135 embedded exposing the top section of the shear bars 135 for receiving the roof slab connector 206. Alternatively, the roof slab connector 206 can be a sheet of solid metal with four holes bored in four positions which correspond to the positions of the shear bars 135 embedded in the walls of the PPVC modules 208,210.

The placement of the PPVC modules 208, 210 is with respect to a three-dimensional coordinate system 212 (also known as artesian coordinate system). The second PPVC module 210 is positioned on the adjoining long face 102 of the first PPVC module 208 having he PPVC connectors 126, 128, 129 specifically in the x-axis direction. The PPVC modules 208, 210 can also be placed on top of the first PPVC module 208 and the second PPVC module 210 in the z-axis direction as shown in FIG. 7. More PPVC modules can also be placed in the x-axis direction provided there are PPVC connectors available in the PPVC module in that direction. Both x-axis and y-axis represent lateral directions of the PPVC modules 208, 210, whilst the z-axis represents a vertical direction of the PPVC modules 208, 210. If using a cylindrical coordinate system, both x-axis and y-axis are radial directions, whilst z-axis is known as cylindrical or longitudinal axis, such as longitudinal axes of the PPVC connectors or assemblies 126, 128, 129.

Functionally, the PPVC connectors 126, 128, 129 provides a coupling means to couple two walls together. The PPVC connector 126, 128, 129 can comprise the first assembly 126 and the second assembly 128. Terms of PPVC connector, connector and the assembly 126,128, 129 are coupling means which are analogous, sometimes used interchangeably.

The two walls 112,114 which is part of the PPVC module 208 are made of concrete which is a composite material composed of fine and coarse aggregate bonded together with a fluid cement that hardens over a time period. The aggregate is a broad category of coarse to medium grained particulate material used in construction, including sand, gravel, crushed stone, slag, recycled concrete and geo-synthetic aggregates.

The first assembly 126 comprises a C-channel 150 and a lipped C-channel 152. A first C-channel 150 is embedded in the first wall 112 and a second C-channel 150 is embedded in the second wall 114. The two C-channels 150 embedded in the two walls provide the anchor which extends from the top face 116 to the bottom face 118 of the wall.

The lipped C-channel comprises the restrictor 134 which provides a coupling of the two walls together by securing the two C-channels 150. The lipped C-channel is communicatively engaged with the two C-channels 150 by sliding downwards from the top face 116.

The C-channel 150 and the lipped C-channel 152 are made of structural steel. Structural steel is used and can be described as 'S275J2' or 'S355K2W'. In these examples, 'S' denotes structural rather than engineering steel; 275 or 355 denotes the yield strength in Newton per square millimetre or the equivalent mega Pascals; J2 or K2 denotes the materials toughness by reference to Charpy impact test values; and the 'W' denotes weathering steel. Further letters can be used to designate fine grain steel ('N' or 'NL'); quenched and tempered steel ('Q' or 'QL'); and thermos-mechanically rolled steel ('M' or 'ML'). Alternatively, steel used for building construction in the United States use standard alloys identified and specified by ASTM (American Section of the International Association for Testing Materials) International.

In practice, a first PPVC module 208 comprising at least one wall is installed on a levelled plane. The levelled plane can be structural pillars which are supporting the first PPVC module 208 from beneath. The structural pillars have protruding rebar that provides the installation of the first PPVC module 208 thereon. Subsequent PPVC modules 208 are installed either next to the first PPVC module 208 or on top of it. Hence, the lipped C-channel is inserted from the top face of the wall through the two C-channels 150. As the rebar from the structural pillars extends into the bottom of the C-channels 150 of the first PPVC module 208, the lipped C-channel 152 inserted via the top face 116 will have exposed partial section extending from the top face 116. The exposed partial section of the lipped C-channel 152 is to provide a guide for the insertion of another C-channel 150 of another PPVC module 208 stacked on top.

The concentric holes 186 on the overhanging extensions 166 of the C-channel 150 provides a channel for the grout to flow freely in a cavity. The cavity refers to a hollow space in the C-channel 150. The grout is to filled the cavity. The concentric holes 186 on the lipped base portion 192, the lipped right portion 194 and the lipped left portion 196 provides the free flowing of the grout in the cavity as well as in the grating gap 110. The grating gap 110 is formed with the two walls are in close proximity but not contacting so as to allow the grout to bind the two walls together and also provides an expansion gap in hot weather. As the grout is of a certain viscosity, the concentric hole gap 190 between each concentric hole 186 is kept at 50 mm to ensure complete immersion of the grout without any air pocket formed.

The overhanging extensions 166 of the C-channel 150 and the lipped overhanging portion 198 of the lipped C-channel 152 provide a gap and a guide when inserting the lipped C-channel 152. The gap can be marginally proximal to each other (referring to the two C-channels 150 and the lipped C-channel 152). To ensure a fixed gap between two lipped C-channels 152 and to facilitate easy installation, the rebar 172 is used to join the two lipped C-channels 152 specifically at the lipped base portions 192. The rebar 172 can be chosen to be longer to have the lipped C-channel 152 proximal to the C-channels 150 or shorter to be spaced further apart.

The corrugated pipe 178 is joined to the inner surface specifically at the centre of the base portion 154 of the C-channel 150. The corrugated pipe 178 provides a sleeve and a guide for the insertion of the dowel bar 182. The dowel bar 182 provides added structural strength. The corrugated pipe 178 extends partially along the C-channel 150 for allowing a lower section end of the dowel bar 182 to be covered by the grout. An upper section of the dowel bar 182 is in the corrugated pipe 178. Grout also flows into the corrugated pipe 178 engulfing the dowel bar 182. The corrugated pipe 178 having the uneven surface provides additional bonding of the grout thereon.

The second assembly 128 provides an alternative to the coupling of the two walls. Two shear bars 135 are embedded into the wall specifically at the adjoining long face 102 of each wall. Only a partial top end of the shear bars 135 are exposed to provide the restrictor 134 to attach itself to the two shear bars 135. The indentation depth 148 of the second assembly extends partially below the top face 116 of the wall. The indentation depth 148 provides a fixed distance on how far the restrictor 134 can travel. The second assembly can provide some sort of locking mechanism to secure the two walls prior to installing the lipped C-channels 152 into the C-channels 150 for the first assembly 126.

Figure 8:
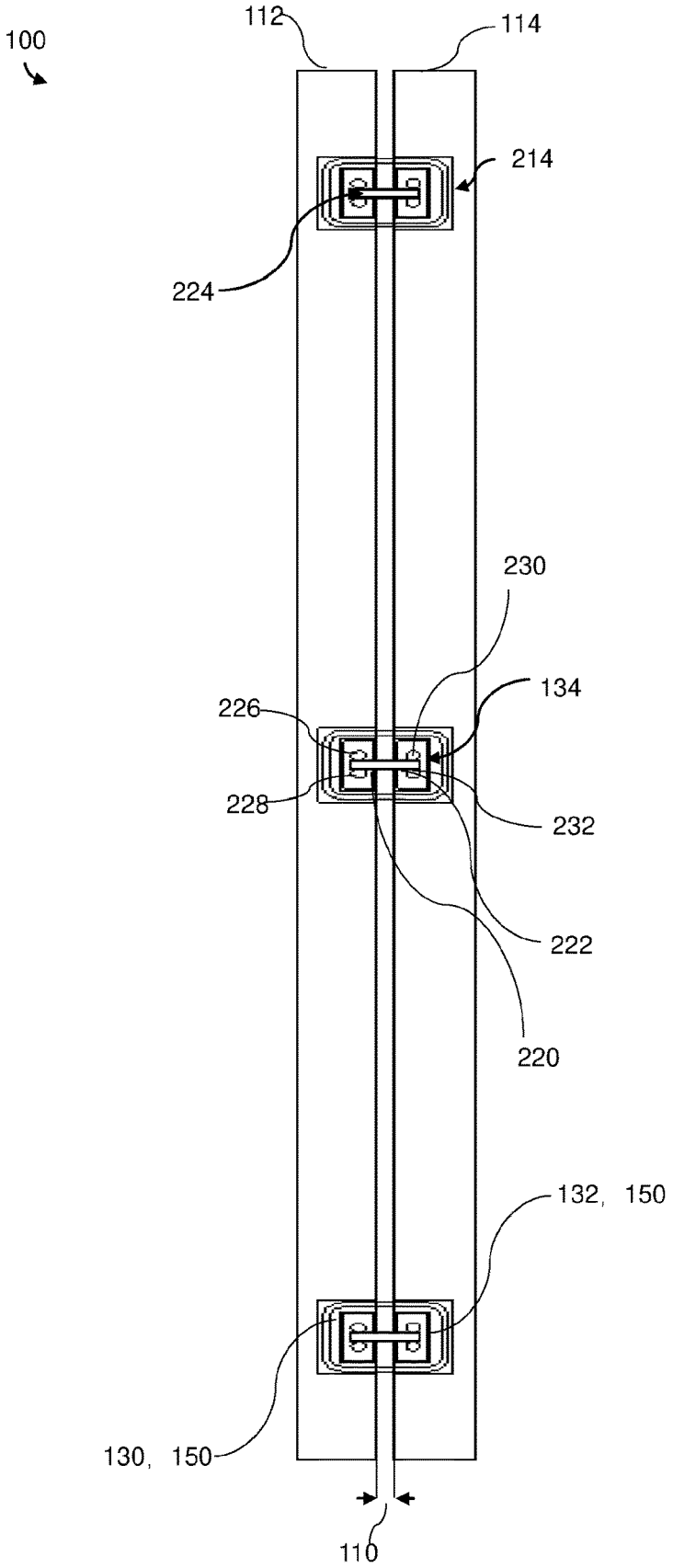
FIG. 8 illustrates a plan of two facing walls with an assembly of a second embodiment.

FIG. 8 to FIG. 15 show a second embodiment of the present application. Similar to FIG. 1, FIG. 8 illustrates a plan of two facing walls with an assembly 100. The only different is that the first assembly 126, the second assembly 128 and the third assembly 129 are replaced by a fourth assembly 214 respectively. Each assembly 214 comprises an at least one anchor and a frame or restrictor 134. Similarly, the frame 134 brings the two anchors 130, 132 together which further holds the two walls 112, 114 in a face-to-face configuration. The first assembly 126 and the second assembly 128 are separated by a space or gap from fifty to one thousand and five hundred millimetres (i.e. 50-1500 mm), one hundred to one thousand and four hundred millimetres (i.e. 100-1400 mm), one hundred and fifty to one thousand and three hundred (i.e. 150-1300 mm), two hundred to one thousand and two hundred millimetres (i.e. 200-1200 mm), two hundred and fifty to one thousand and one hundred millimetres (i.e. 250-1100 mm), or preferably three hundred to one thousand millimetres (i.e. 300-1000 mm).

As shown in FIG. 8, the anchors 130, 132 of the fourth assembly 214 are identical; and each of the anchors 130, 132 has a rectangular shape with a length from sixty to one hundred millimetres (60-100 mm) and a width of from forty to sixth millimetres (40-60 mm). The first anchor 130 and the second anchor 132 have a first opening 220 and a second opening 222 respectively. The two openings 220, 222 face each other and are separated by the grating gap 110. The openings 220, 222 have a same size from twelve to twenty-five millimetres (12-25 mm). The frame 134 of the fourth assembly 214 comprises a dumbbell coupler (also known as shaft, rod, rebar or tie bar) 224 and four elongated poles 226, 228, 230 and 232. The dumbbell coupler 224 has a diameter from ten to sixteen millimetres (10-16 mm), a width from ninety to one hundred and twenty millimetres (90-120 mm) and a length equivalent to building storey height typically from two thousand, nine hundred and fifty to three thousand, one hundred and fifty millimetres (2950-3150 mm). The four elongated poles 226, 228, 230 and 232 are identical and thus have a same diameter from sixteen to thirty-two millimetres (16-32 mm) and a same length from ninety to one hundred and twenty millimetres (90-120 mm). The two elongated poles 226, 228 of the anchor 130 have a distance from ten to one hundred and fifty millimetres (10-150 mm), twenty to one hundred and forty millimetres (20-140 mm), thirty to one hundred and thirty millimetres (30-130 mm), forty to one hundred and twenty millimetres (40-120 mm), forty-five to one hundred and ten millimetres (45-110 mm), or preferably fifty to one hundred millimetres (50-100 mm).

Figure 9:
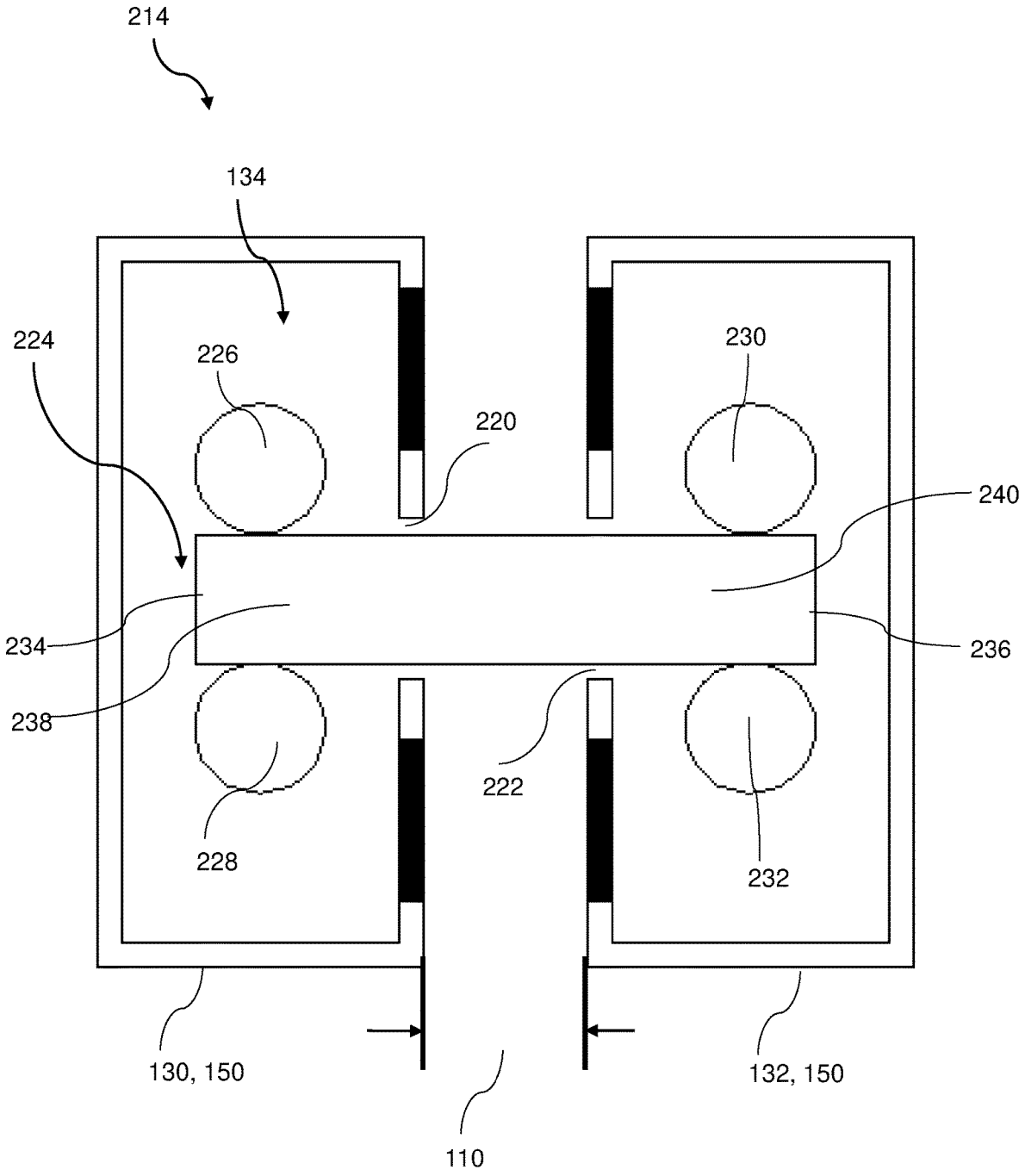
FIG. 9 illustrates a plan of the assembly for coupling the two facing walls of a second embodiment.

In the fourth assembly 214, the dumbbell coupler or shaft 224 has a first end 234 and a second end 236 (shown in FIG. 9). The first elongated pole 226, the second elongated pole 228 and a first portion 238 of the dumbbell coupler 224 including the first end 234 are located inside the enclosure of the first anchor 130; while the third elongated pole 230, the fourth elongated pole 234 and a second portion 240 of the dumbbell coupler 224 including the second end 236 are located inside the enclosure of the second anchor 132. The first elongated pole 226 and second element 228 are connected to the two sides of the first portion 238 respectively. Similarly, the third elongated pole 230 and the fourth elongated pole 232 are also connected to the two side of the second portion 240 respectively. As a result, the frame 134 brings the two anchors 130, 132 together and further holds the two walls 112, 114 in a face-to-face configuration.

In the fourth assembly 214, for installing the frame 134 with the two anchors 130, 132, the size of the two openings 220, 222 is larger than the diameter of the dumbbell coupler 224 but smaller than the farthest distance between the first elongated pole 226 and the second elongated pole 228, i.e. sum of the diameter of the first elongated pole 226, the diameter of the dumbbell coupler 224 and the diameter of the second elongated pole 228. In addition, the sum calculated above is smaller than the length of the first anchor (60-70 mm) for being accommodated into the first anchor 130. As a result, the frame 134 couples the two anchors 130, 132 together such that the PPVC connector couples the first wall 112 and the second wall 114 securely as a whole.

Figure 10:
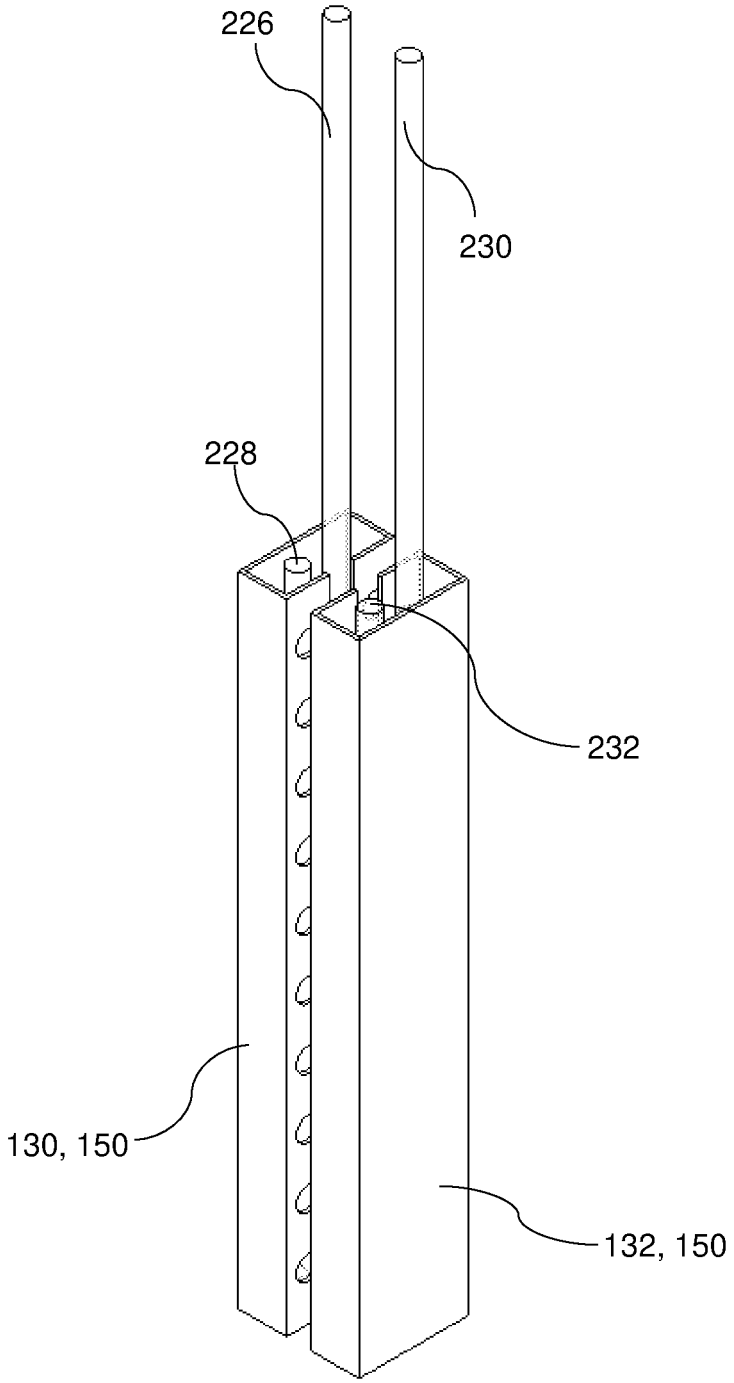
FIG. 10 illustrates a perspective of the assembly for coupling the two facing walls of a second embodiment.

Similar to FIG. 2, FIG. 9 illustrates a plan of the assembly for coupling the two facing walls for the second embodiment. The fourth assembly 214 comprises two identical C-channels 150 as the anchors 130, 132. FIG. 10 illustrates a perspective of the assembly for the second embodiment. In particular, the first elongated pole 226 and the third elongated pole 230 protrude from a top side 131 of the first anchor 130 or the second anchor 132 in a height direction. Meanwhile, the second elongated pole 228 and the fourth elongated pole 232 also protrude from a bottom side 133 of the first anchor 130 or the second anchor 132 (not shown). The protruding portions of the elongated poles 226, 230 are used for directing and fixing another PPVC connector stacked upwards by extending the protruding portions into the upwardly stacked PPVC connector. Similarly, the protruding portions of the elongated poles 228, 232 are used for directing and fixing another PPVC connector stacked downwards by extending the protruding portions into the downwardly stacked PPVC connector.

Figure 11:
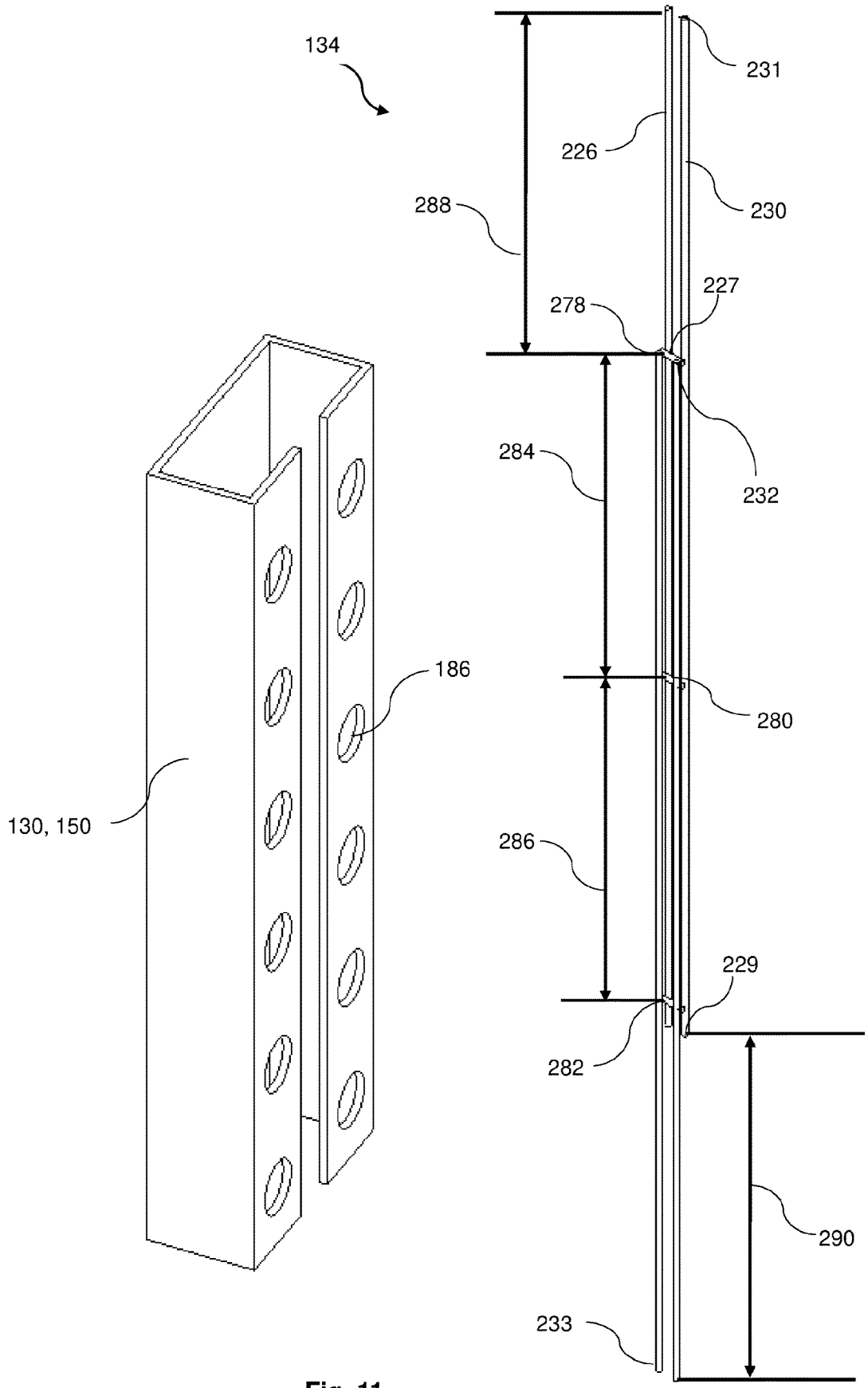
FIG. 11 illustrates an exploded view of a C-channel and a dumbbell coupler of the second embodiment.

FIG. 11 illustrates an exploded view of a C-channel and a dumbbell coupler of the second embodiment. The frame 134 comprises a first shaft 278, a second shaft 280 and a third shaft 282 connecting the elongated poles 226, 228, 230, 232. The shafts 278, 280, 282 are placed in a parallel configuration. In particular, the first shaft 278 is positioned around a first top end 227 of the second elongated pole 228 or the fourth elongated pole 232. The first shaft 278 and the second shaft 280 are separated by a first interval 282; and the second shaft 280 and the third shaft 282 are also separated by a second interval 284. The first interval 282 and the second interval 284 may have a same value or different values according to specific requirements. For example, the intervals 284, 286 have a same value of two hundred millimetres to two thousand millimetres (200-2000 mm), three hundred millimetres to one thousand and nine hundred millimetres (300-1900 mm), three hundred and fifty millimetres to one thousand and eight hundred millimetres (350-1800 mm), four hundred millimetres to one thousand and seven hundred millimetres (400-1700 mm), four hundred and fifty millimetres to one thousand and six hundred millimetres (450-1600 mm), or five hundred millimetres to one thousand and five hundred millimetres (500-1500 mm). Preferably, the intervals 284, 286 have a same value of five hundred millimetres to one thousand millimetres (500-1000 mm).

As shown in FIG. 11, the upwardly protruding portion of the first elongated pole 226 or the third elongated pole 230 has a first length 288 as a first tension lap length of reinforcement (typically forty (45) to fifty (50) times larger than the diameter of elongated pole or rebar 226, 230) from the first top end 227 to a second top end 231 of the first elongated pole 226 or the third elongated pole 230. The downwardly protruding portion of the second elongated pole 228 or the fourth elongated pole 232 has a second length 290 as a second tension lap length of reinforcement (typically forty (45) to fifty (50) times larger than the diameter of the elongated pole or rebar 228, 232) from a first bottom end 229 of the first elongated pole 226 or the third elongated pole 230 to a second bottom end 233 of the second elongated pole 228 or the fourth elongated pole 232. If all the elongated poles 226, 228, 230, 232 have a same length equal to the tension lap length 288, 290 of reinforcement, the first length 288 and the second length 290 also have a same length.

Similar to the C-channel 150, FIG. 11 shows a plurality of concentric holes 186 in two parallel lines formed on the circular channel 242. There are concentric holes 186 having a same diameter of twenty to thirty millimetres (20-30 mm). The concentric holes 186 are equally distributed about fifty to one hundred millimetres (50-100 mm) from center to center; and the concentric hole gap 190 between two adjacent concentric holes 186 is about fifty to one hundred millimetres (50-100 mm). The concentric holes 186 on the circular channel 242 in FIG. 9 are representation only.

Figure 12:
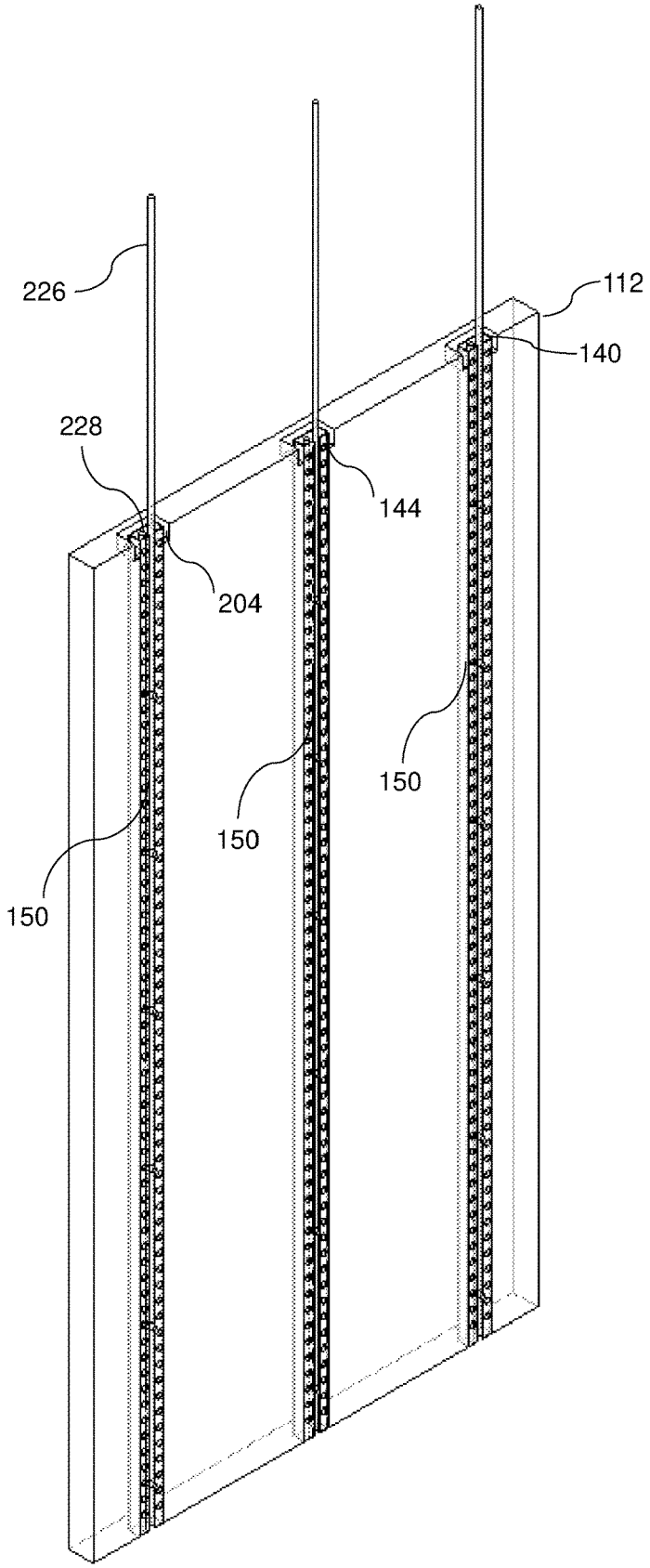
FIG. 12 illustrates a perspective of an inner face of a first wall having three indentations of a second embodiment.

Similar to FIG. 4, FIG. 12 illustrates a perspective of an inner face of a first wall having three indentations of a second embodiment, i.e. the first indentation 140, the third indentation 144 and the fifth indentation 204. Each of the indentations 140, 144, 204 has a C-channel 150 embedded therein. Each the indentations 140, 144, 204 extends along the first wall 112 in a height direction; and thus has a length equal to a wall height 108 of three thousand, one hundred and fifty millimetres (3150 mm) typically. The frame 134 is joined to the C-channel 150 in each of the indentations 140, 144, 204, comparing the first elongated pole 226 and the second elongated pole 228. As discussed in FIG. 12, the upwardly protruding portion in each of the indentations 140, 144, 204 has a length of fifty to one hundred millimetres (50-100 mm). The downwardly protruding portion is not shown in FIG. 12.

The other features are the same as disclosed in the FIG. 4. Particularly, the frame 134 also comprises three shafts 278, 280, 282 that connect the elongated poles 226, 228 together and also holds the elongated poles 226, 228 parallel. The shafts are also parallel to each other, but orthogonal to the elongated poles 226, 228. Two adjacent dumbbell couplers are separated apart by a distance of three hundred millimetres to one thousand millimetres (300-1000 mm).

Figure 13:
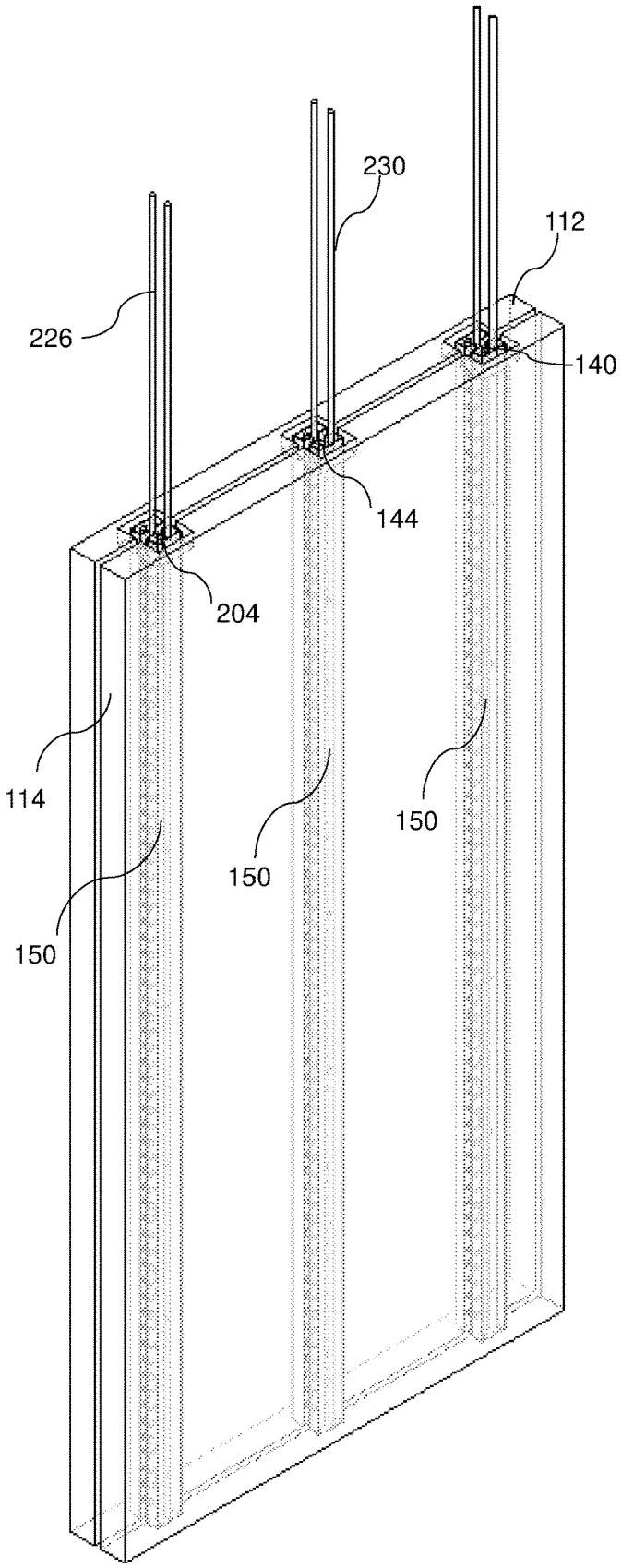
FIG. 13 illustrates a perspective of two facing walls with the assembly of a second embodiment.

Similar to FIG. 5, FIG. 13 illustrates a perspective of two facing walls 112, 114 with the assembly 126, 128 and 129 of a second embodiment. Two similar or identical walls 112, 114 are positioned in which the adjoining long faces 102 are facing each other. Hold in the position, the first indentation 140 of the first wall 112 meets the fifth indentation 204 of the second wall 114. The second indentation 142 of the first wall 112 meets the fourth indentation 202 of the second wall 114. The third indentation 144 of the first wall 112 meets the third indentation 144 of the second wall 114. The fourth indentation 202 of the first wall 112 meets the second indentation 142 of the second wall 114. The fifth indentation 204 of the first wall 112 meets the first indentation 140 of the second wall 114.

The frame 134 is inserted into the two adjoining C-channels 150 in the indentations 140, 144, 204 of the first wall 112 and the indentation 204, 144, 140 of the second wall 114, respectively. The frame 134 is positioned orthogonally with respect to the C-channel 150 before inserting in the two C-channels 150 of the first assembly 126, the second assembly 128 and the third assembly 129, respectively. The upwardly protruding portion is also shown of the first elongated pole 226 and the third elongated pole 230. The downwardly protruding portion are not shown in FIG. 13.

Figure 14:
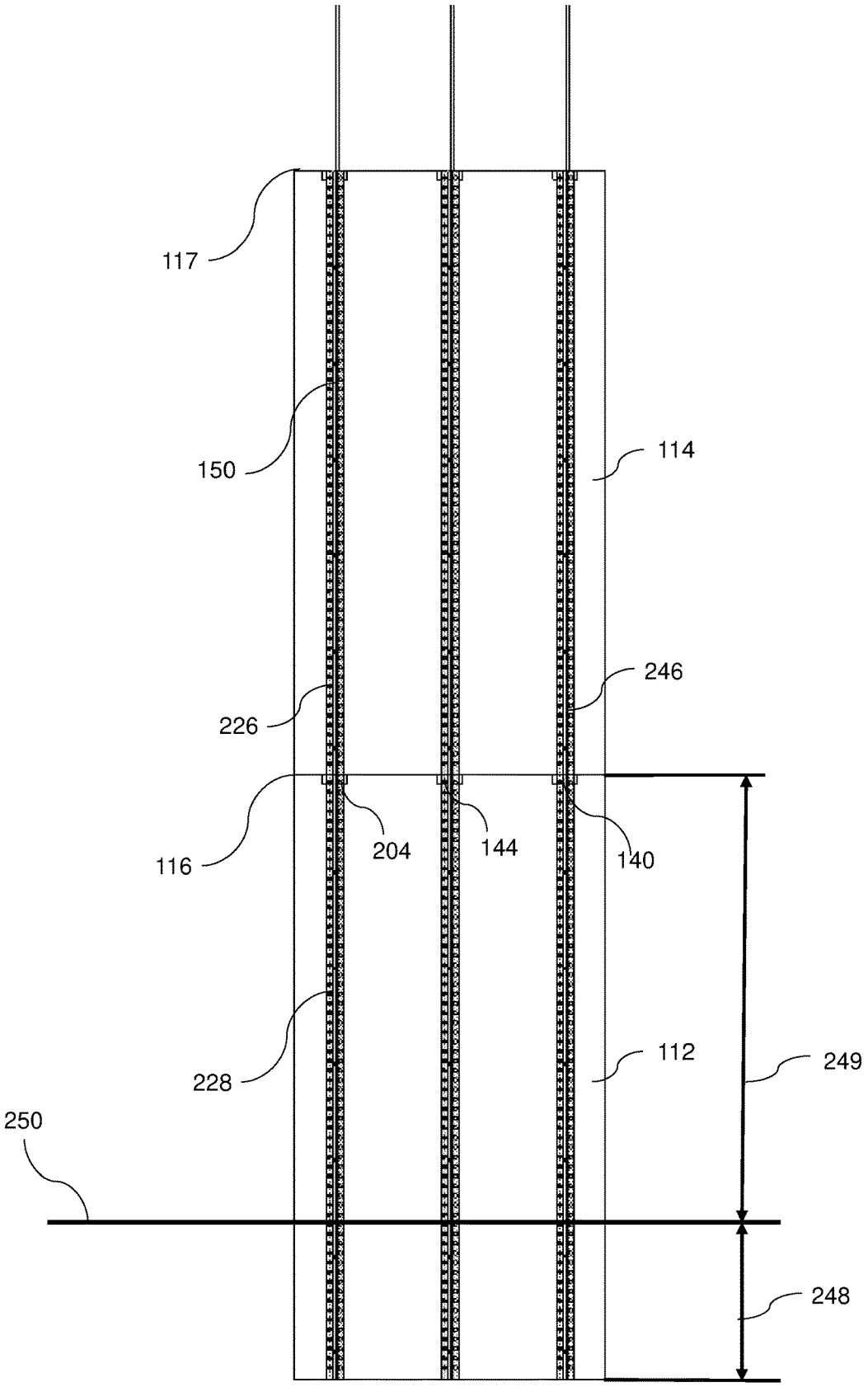
FIG. 14 illustrates a side view of two walls stacked on top of each other of a second embodiment.

Similar to FIG. 6, FIG. 14 illustrates a side view of two walls stacked on top of each other of a second embodiment. Two similar to identical walls are stacked, i.e. the second wall 114 is stacked on top of the first wall 112. Hold in the position, the first indentation 140 of the first wall 112 meets the first indentation 140 of the second wall 114 for forming an elongated indentation throughout the first wall 112 and the second 114 in height. The frame 134 protrudes from the top face 116 of the first wall 112 extends into the bottom of the C-channel 150 of the second wall 114. The extension of the frame 134 of the first wall 112 into the C-channel 150 of the second wall 114 is called an overlapping zone 246 of the first indentations 140. The frame 134 of the second wall 114 protrudes out from the second top face 117 of the second wall 114. The structure for the third indentation 144 or the fifth indentations 204 of the first wall 112 and the second wall 114 are the same as that of the first indentation 140 describe above. In addition, a third wall 244 (not shown) similar or identical to the first wall 122 or the second wall 124 may be also installed by being stacked on the second wall 114 in the same way. Each of the indentations 140, 144 and 204 has the overlapping zone 246 in the third wall 244.

As shown in FIG. 14, the first wall 112 comprises a bottom portion 248 and a top portion 249. The bottom portion 248 is embedded underground below a floor level 250. The bottom portion 248 has a height equal to the tension lap length 288, 290 of connector dumbbell rebar (typically eight hundred millimetres (800 mm) for sixteen millimetres (16 mm) diameter rebar) below the floor level 250. As a result, the first wall 112 lays a solid foundation and thus can support a PPVC module for a building, especially for a high-rise building.

Figure 15:
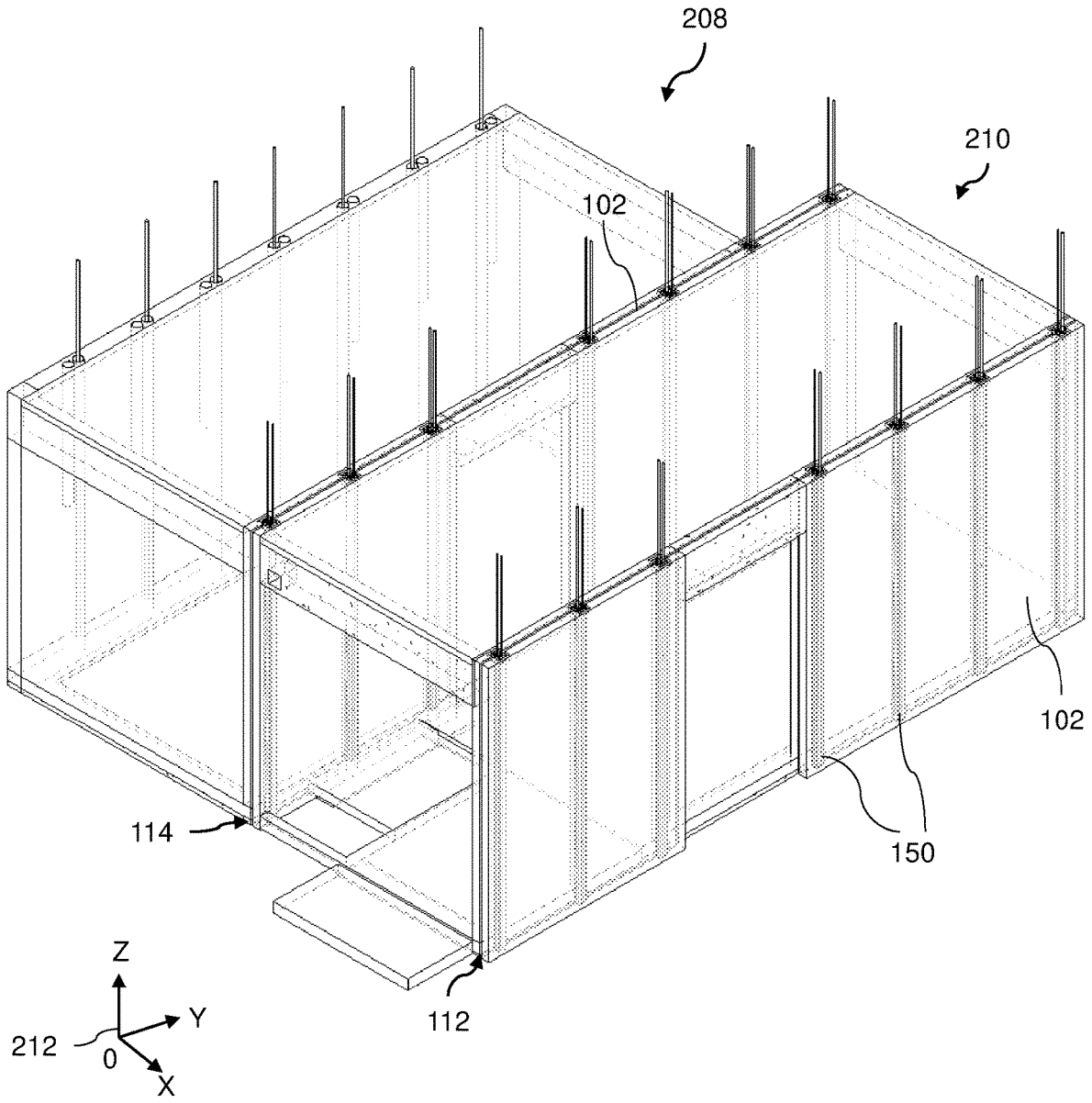
FIG. 15 illustrates a perspective of two PPVC modules joined at an adjoining long face of a second embodiment.

Similar to FIG. 7, FIG. 15 illustrates a perspective of two PPVC modules 208 joined at an adjoining long face 102 of a second embodiment. The first PPVC module 208 is a terminating PPVC module which has PPVC connectors only on one side thereof. The second PPVC module 210 has PPVC connectors on the two adjoining long faces 102 thereof. The PPVC connectors comprise multiple C-channels 150 acting as the anchors and multiple frames 134 acting as the couplers. The other information of the PPVC modules 208 is as explained in FIG. 7.

As described above, the frame 134 is protruded over the first top face 116 and the second top face 117 of the two walls 112,114. A third PPVC module 276 is attached onto the first PPVC module 208 vertically. In other words, the third PPVC module 276 is stacked onto the top of the first PPVC module 208. The protrusions of the frame 134 further extends into the third PPVC module 208 for temporarily holding the first PPVC module 208 in position, then a filler is filled and cured for joining the first PPVC module 208, the second PPCV module 210 and the third PPVC module 276 by confinement effect.

Figure 16:
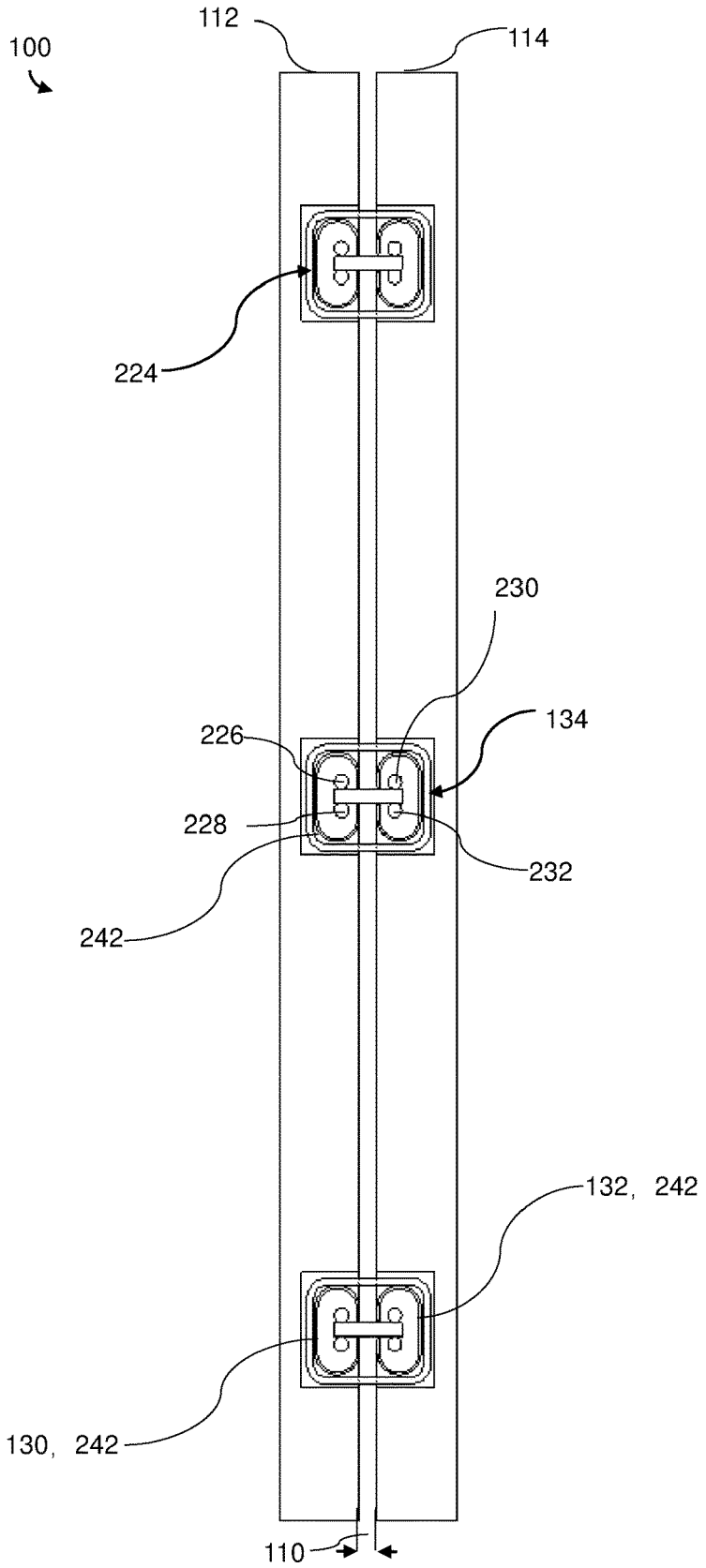
FIG. 16 illustrates a plan of two facing walls with an assembly of a third embodiment.

FIG. 16 to FIG. 24 show a third embodiment of the present application. FIG. 16 illustrates a plan of two facing walls with an assembly of a third embodiment, similar to the fourth assembly 214, the fifth assembly 216 of the third embodiment comprises the first anchor 130, the second anchor 132 and the frame 134 respectively. In the fifth assembly 216, each of the anchors 130, 132 is a circular channel 242 having a rectangular shape with side of 150 mm. Other features in the third embodiment remain the same as those in the second embodiment.

Figure 17:
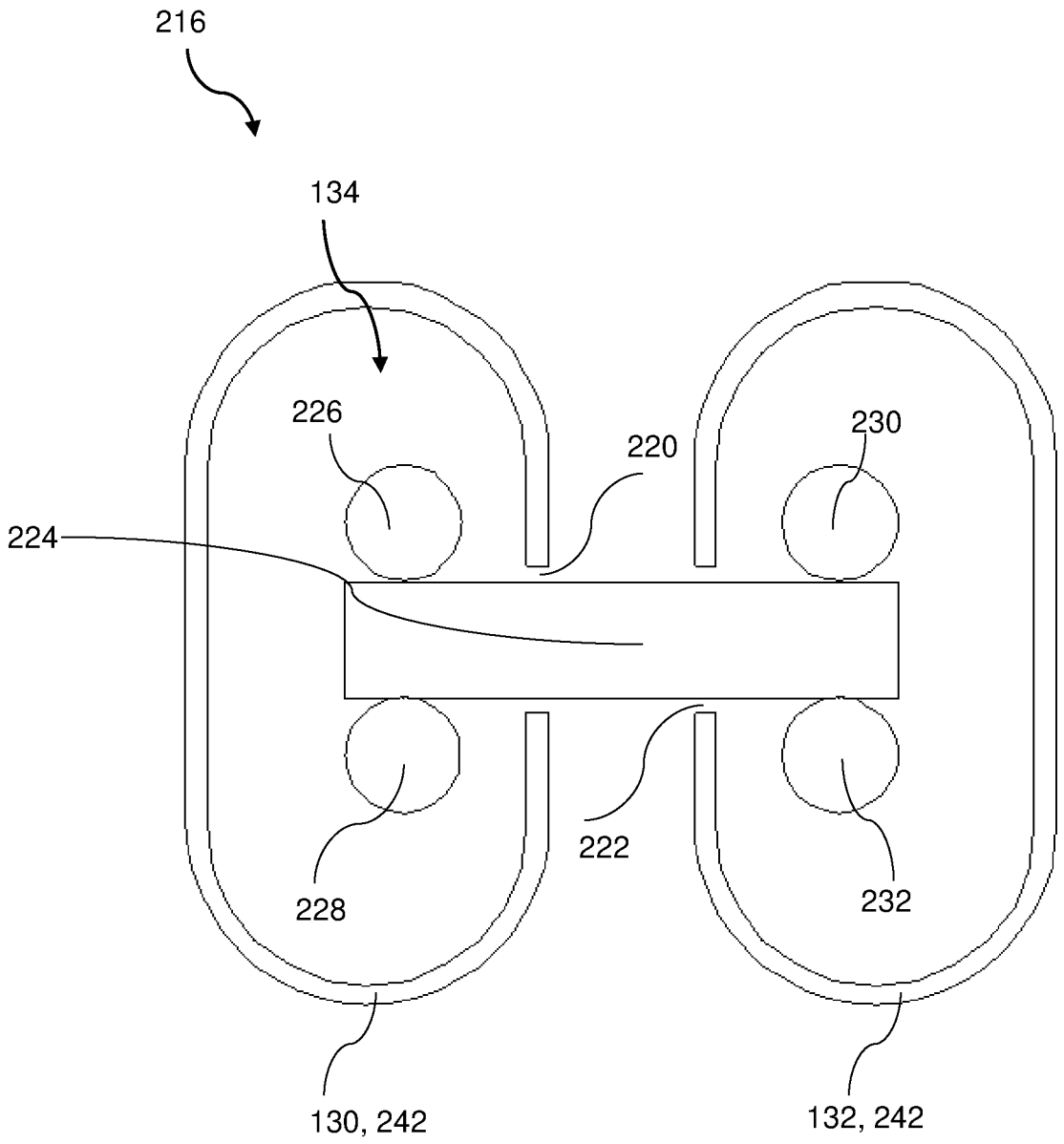
FIG. 17 illustrates a plan of the assembly for coupling the two facing walls of a third embodiment.
Figure 18:
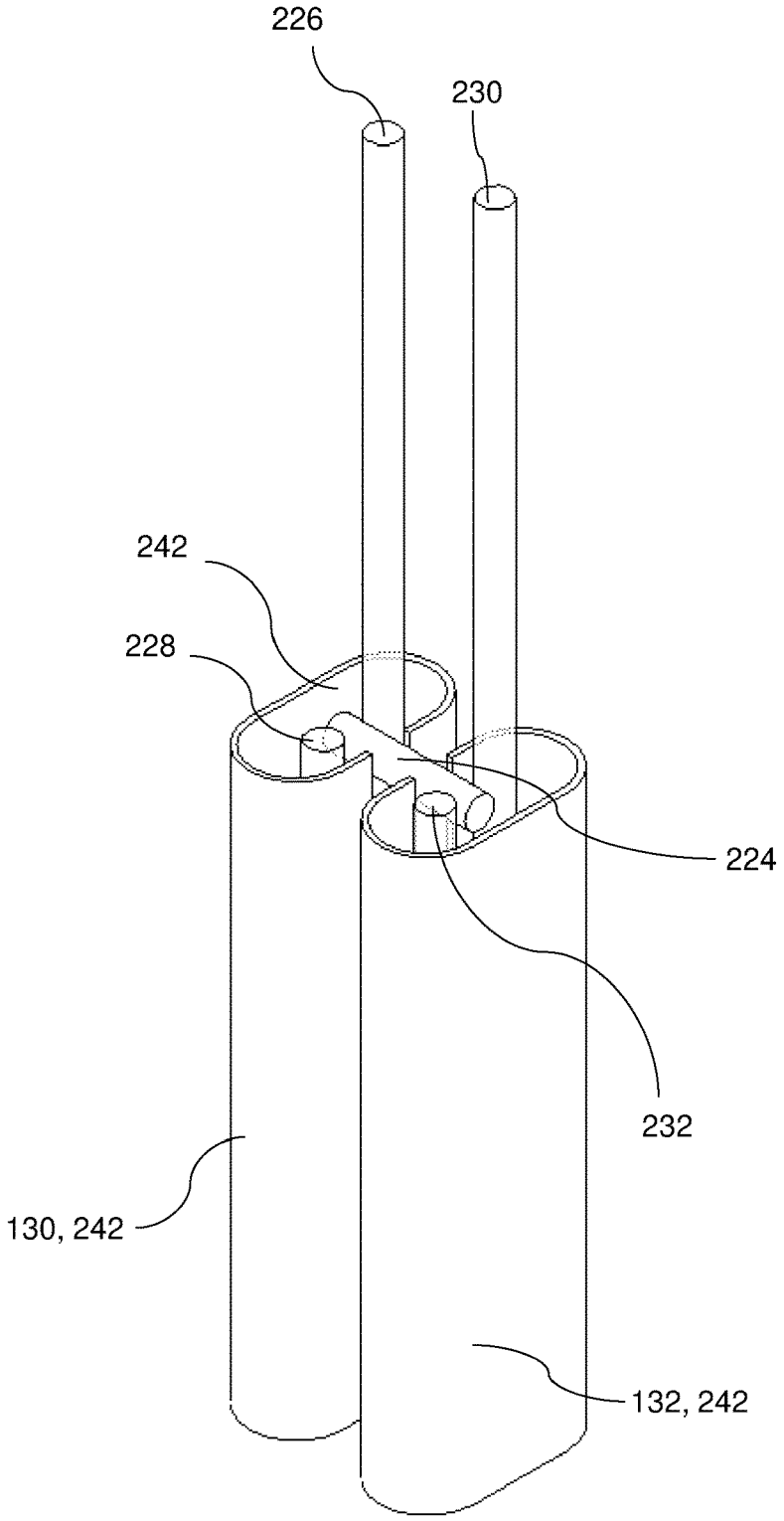
FIG. 18 illustrates a perspective of the assembly for coupling the two facing walls of a third embodiment.
Figure 19:
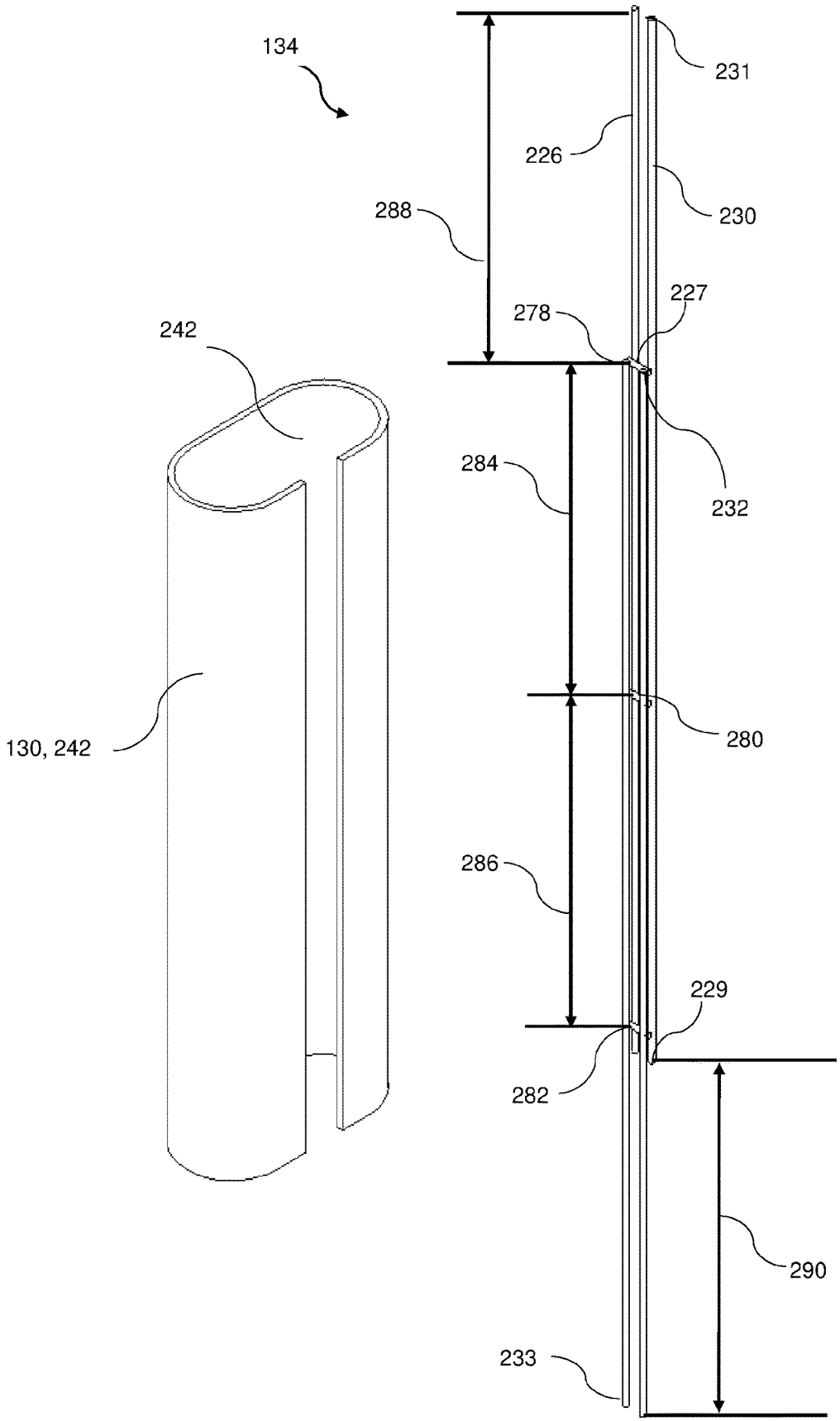
FIG. 19 illustrates an exploded view of a C-channel and a dumbbell coupler of the third embodiment.

FIG. 17 illustrates a plan of the assembly for coupling the two facing walls of a third embodiment. In contrast to the fourth assembly 214, the fifth assembly 216 comprises two identical circular channels 242 as the anchors 130, 132. FIG. 18 illustrates a perspective of the assembly for the second embodiment. Similar to FIG. 10, the first elongated pole 226 and the third elongated pole 230 protrude from the first anchor 130 and the second anchor 132 respectively in a height direction. Meanwhile, the second elongated pole 228 and the fourth elongated pole 232 have substantially the same height as the first anchor 130 and the second anchor 132. FIG. 19 illustrates an exploded view of a C-channel and a dumbbell coupler of the third embodiment. All the features are the same as those in the FIG. 11, except that the first anchor 130 has a circular channel 242.

Figure 20:
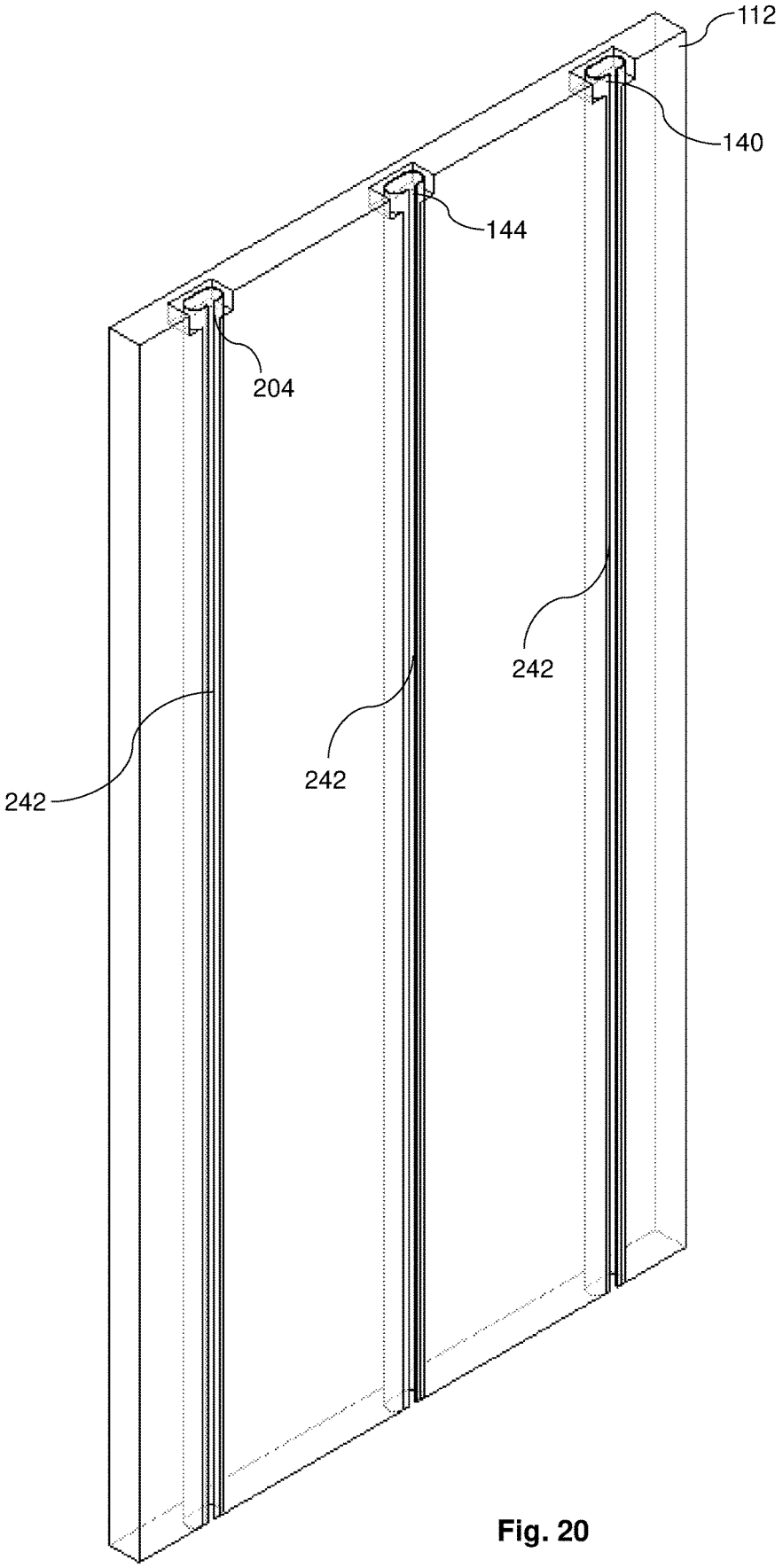
FIG. 20 illustrates a perspective of an inner face of a first wall having three indentations of a third embodiment.

Similar to FIG. 12, FIG. 20 illustrates a perspective of an inner face of a first wall having three indentations of a third embodiment, i.e. the first indentation 140, the third indentation 144 and the fifth indentation 204. Each of the indentations 140, 144, 204 has a circular channel 242 embedded therein. The other features are the same as those in the FIG. 12. The frame 134 comprising four elongated poles 226, 228, 230, 232 and the three shafts 278, 280, 282 are not shown.

Figure 21:
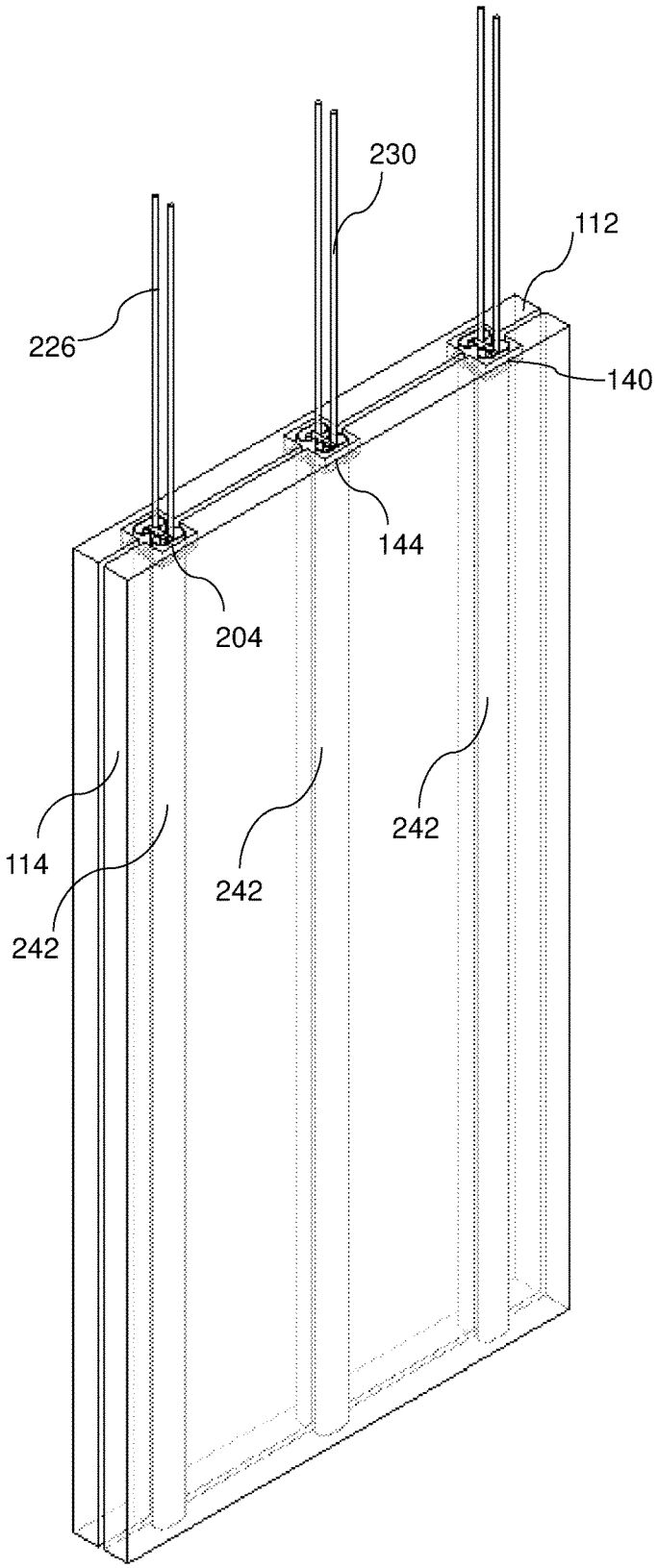
FIG. 21 illustrates a perspective of two facing walls with the assembly of a third embodiment.
Figure 22:
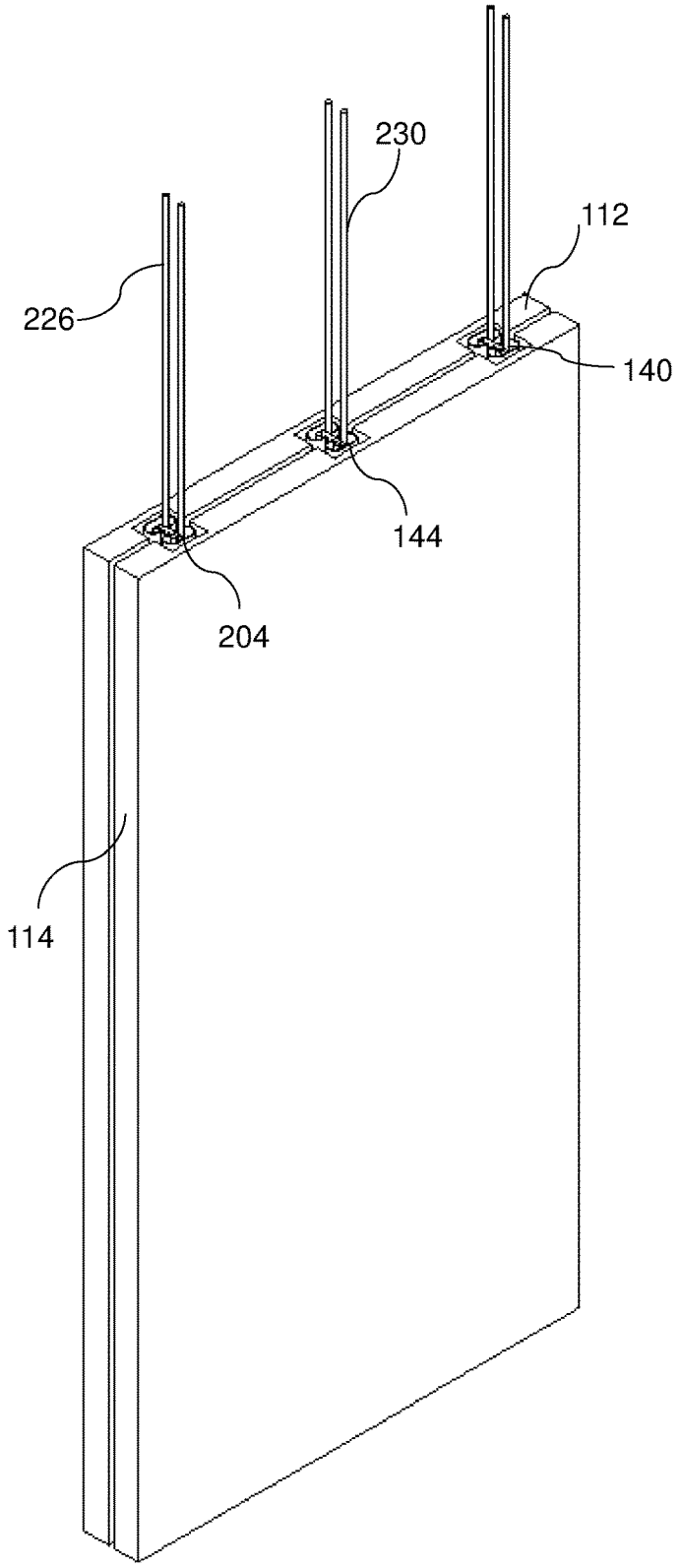
FIG. 22 illustrates a side view of two facing walls with the assembly of a third embodiment.
Figure 23:
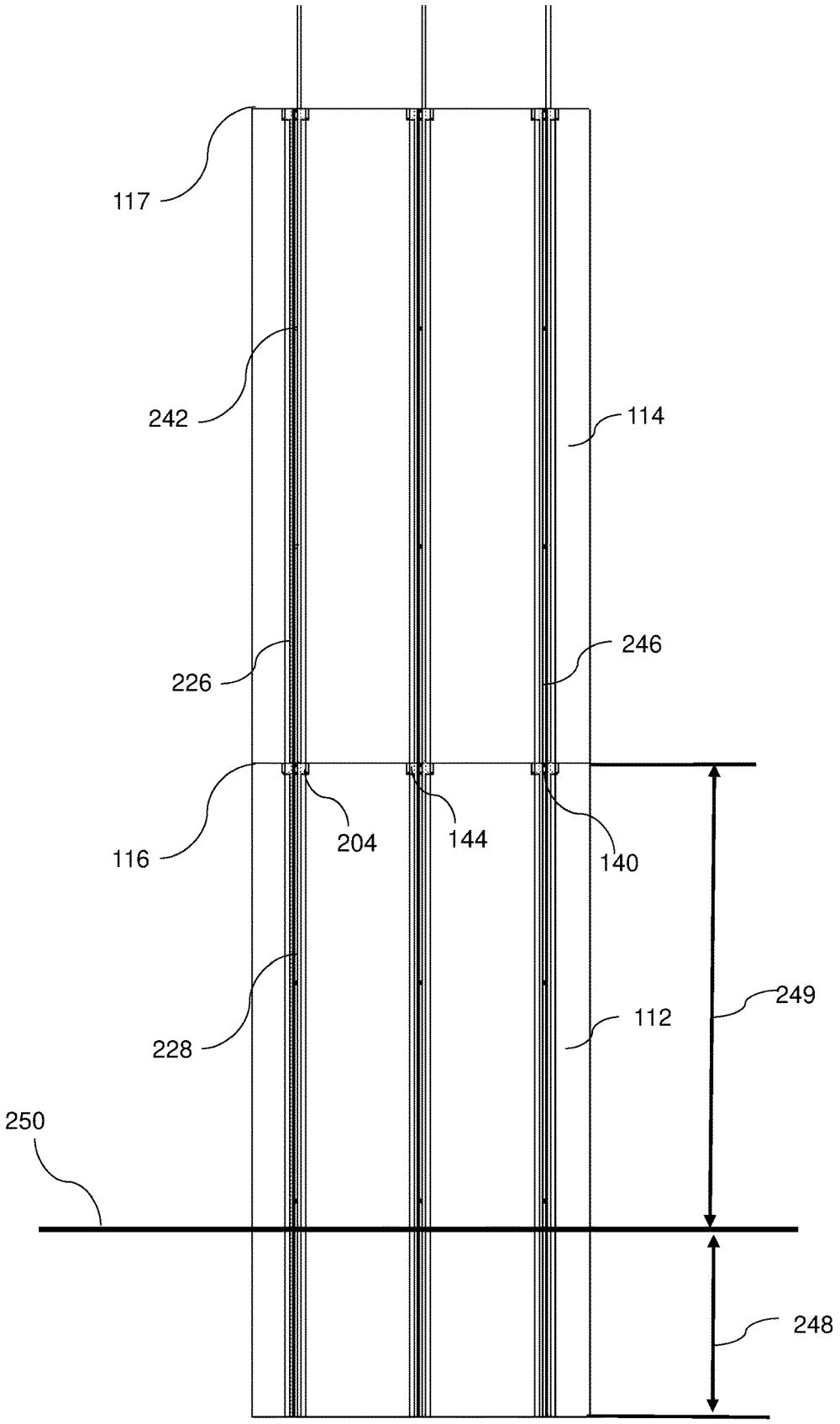
FIG. 23 illustrates a side view of two walls stacked on top of each other of a third embodiment.
Figure 24:
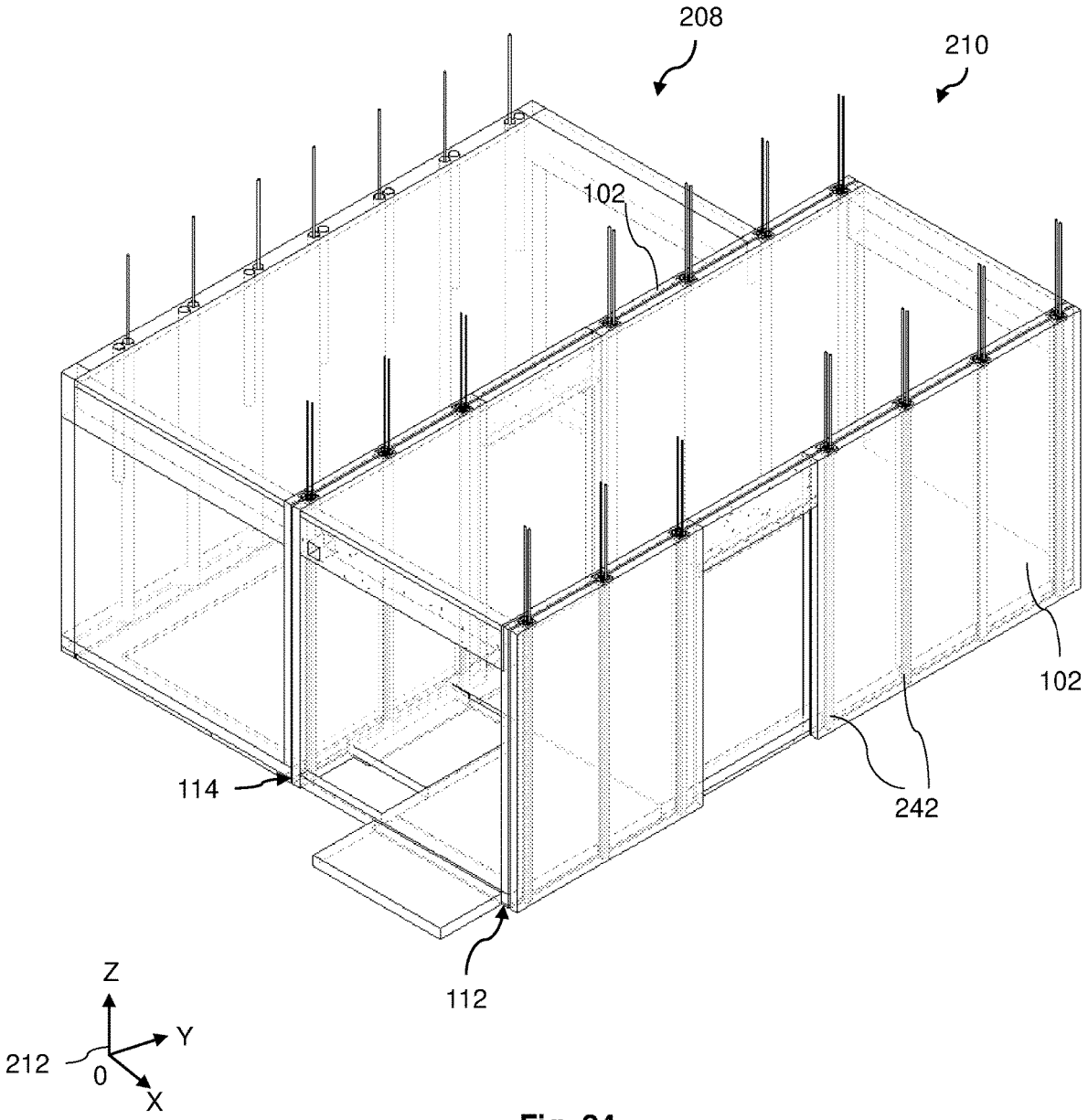
FIG. 24 illustrates a perspective of two PPVC modules joined at an adjoining long face of a third embodiment Exemplary, non-limiting embodiments of relevant inventions will now be described with references to the above-mentioned figures.

FIG. 21 illustrates a perspective of two facing walls with the assembly of a third embodiment. Similar to the FIG. 13, the frame 134 is also inserted into two adjoining circular channels 242 in the indentations 140, 144, 204 of the first wall 112 and the second wall 114. The frame 134 is positioned orthogonally with respect to the circular channels 242 before inserting in the two circular channels 242 of the first assembly 126, the second assembly 128 and the third assembly 129, respectively. FIG. 22 illustrates a side view of two facing walls with the assembly of a third embodiment. The upwardly protruding portion is also shown of the first elongated pole 226 and the third elongated pole 230. The downwardly protruding portion are not shown in FIG. 21 and FIG. 22.

The circular channel 242, the elongated poles 226, 228, 230 and 232 and the dumbbell coupler 224 of the frame 134 are made of a same or similar material of the C-channel 150, such as the structural steel discussed above. A filler such as non-shrink grout or cement is then filled into empty space in the first indentations 140, the third indentations 144 and the fifth indentations 204, where the first anchor 130 and the second anchor 132 form an enclosure with the grating gap. The enclosure provides confine effect when the grating gap is filled and then sealed with the filler after curing. Inside the enclosure, the frame 134 are surrounded by the filler. As a result, the frame 134 and the enclosure of the anchors 132, 134 provide lateral deformation forces in a loading stage that comprises an initial loading stage and a subsequent loading stage during the curing process. In the initial loading stage, the Poisson's ratio of filler is smaller than that of the frame 134 such that a first lateral interactional force 252 is generated by the frame 134 for squeezing the filler. The first lateral interaction force 252 leads to a stable and strong connection between the frame 134 and the filler. In contrast, when the stress of the anchors 130, 132 exceeds a proportional limit, the Poisson's ratio of the filler is greater than that of the anchors 130, 132, such that a second lateral interactional force 254 is generated by the filler for squeezing the anchors 130, 132 in the subsequent loading stage. The second lateral interaction force 254 also leads to a stable and strong connection between the filler and the anchors 130, 132. Therefore, the anchors 130, 132, the filler and the frame 134 are connected together firmly which further combine the two PPVC modules into a monolithic assembly after the loading stage.

The confinement effect is applicable for both of the first embodiment and the second embodiment of the present application, because each of the anchors 130, 132 and the lipped C-channel 152 in the first embodiment or the frame 134 in the second embodiment has a rigid nature. Therefore, continuous reinforced structure of concrete is formed in-between the PPVC modules. In addition, the frame 134 in the second embodiment has such a simple structure that the frame 134 would not cause any disturbance of concrete continuity.

An apparatus 256 is adopted for making the frame 134 of a second embodiment or the third embodiment. The apparatus 256 comprises a first holder 258 and second holder 260 that are separated apart by a first distance 262. The first holder 258 comprises a first recess 264 and a second recess 266 that are separated apart by a second distance 272. Similarly, the second holder 260 comprises a third recess 268 and a fourth recess 270 that are also separated apart by the second distance 272. Two ends of the first elongated pole 226 are respectively placed on the first recess 264 and the third recess 268 on the opposite. Similarly, two ends of the second elongated pole 228 are also respectively placed on the second recess 266 and the fourth recess 270 on the opposite.

The recesses 264, 266, 268 and 270 have a same size suitable for holding the first elongated pole 226 and the second elongated pole 228. Several dumbbell couplers 224 tie shafts having a diameter of ten to sixteen millimetres (10-16 mm) and a spacing of five hundred to one thousand millimetres (500-1000 mm) with the elongated poles 226, 228. Particularly, the elongated poles 226, 228 has a same diameter ranging from sixteen millimetres (16 mm) to thirty-two millimetres (32 mm). The dumbbell couplers have a same diameter of ten to sixteen millimetres (10-16 mm) The dumbbell couplers are parallel to each other and separated by a third distance of fifty to one hundred millimetres (50-100 mm) between two adjacent dumbbell couplers. In this way, a half of the frame 134 is made.

The PPVC connector provides a method of making which comprises firstly, embedding the first C-channel 150 or circular channel 242 to the first wall 112 of the first PPVC module 208; secondly, embedding the second C-channel 150 or circular channel 242 to the second wall 114 of the second PPVC module 210; and finally coupling the first C-channel 150 and the second C-channel 150 by a lipped C-channel 152 in the first embodiment or a frame 134 in the second embodiment in order to prevent detachment between the first PPVC module 208 and the second PPVC module 210. The C-channels 150 or the circular channels 242 are pre-casted in a mould together with concrete.

A method of assembling the two PPVC modules 208, 210 in particular the two walls which has the PPVC connector. The method comprises bringing the first wall 112 of the first PPVC module 208 and the second wall 114 of the second PPVC module 210 in proximity which form the grating gap 110. To secure the two walls, lipped C-channels 152 in the first embodiment or frames 134 are first placed in the first indentation 140, third indentation 144 and the fifth indentations 204. Followed by placing the roof slab connectors 206 at the second indentation 142 and the fourth indentation 202. Dowel bars 182 are inserted into the corrugated pipes 178. Non-shrink grout or concrete is then poured into the cavities till fully filled.

A method of making the frame 134 in the second embodiment is also disclosed. The method comprises a first step of placing a first elongated pole 226 into the first recess 264 of the first holder 258 and the third recess 268 of the second holder 260; and a second step of placing a second elongated pole 228 into the second recess 266 of the first holder 258 and the fourth recess 270 of the second holder 260. The first elongated pole 226 and the second elongated pole 228 are parallel to each other. To securely connect the elongated poles 226, 228 together, a third step of the method is welding the dumbbell couplers to the elongated poles with a third distance of fifty to one hundred millimetres (50-100 mm) between two adjacent dumbbell couplers. The method further comprises a fourth step of welding a third elongated pole 230 to the dumbbell couplers in such a way that the third elongated pole 230 is opposite to and separated from the first elongated pole 226 by the dumbbell couplers. Finally, the method also comprises a fifth step of welding a fourth elongated pole 232 to the dumbbell couplers in such a way that the fourth elongated pole 232 is opposite to and separated from the first elongated pole 226 by the dumbbell couplers. Overall, the four elongated poles 226, 228, 230 and 232 are made parallel to each other; while the dumbbell couplers are also parallel to each other but orthogonal to the four elongated poles 226, 228, 230 and 232. The fourth step and the fifth step can be conducted either off-site or on-site.

In the application, unless specified otherwise, the terms "comprising", "comprise", and grammatical variants thereof, intended to represent "open" or "inclusive" language such that they include recited elements but also permit inclusion of additional, non-explicitly recited elements.

As used herein, the term "about", in the context of concentrations of components of the formulations, typically means +/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. The description in range format is merely for convenience and brevity and should not be construed as an inflexible limitation on the scope of the disclosed ranges. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

It will be apparent that various other modifications and adaptations of the application will be apparent to the person skilled in the art after reading the foregoing disclosure without departing from the spirit and scope of the application and it is intended that all such modifications and adaptations come within the scope of the appended claims.

REFERENCE NUMERALS

100 plan of two facing walls with an assembly
102 first adjoining long face
104 wall breadth
106 wall length
108 wall height
110 grating gap
112 first wall
114 second wall
116 first top face
117 second top face
118 first bottom face
120 first opposite long face
122 first primary side face
124 first secondary side face
126 first assembly
127 a perspective of the first assembly
128 second assembly
129 third assembly
130 first anchor
131 top side
132 second anchor
133 bottom side
134 restrictor or frame
135 shear bar
136 first assembly-to-side distance
138 first-to-second assembly distance
140 first indentation
142 second indentation
144 third indentation
146 indentation breadth
148 indentation depth
150 C-channel, CC1
152 lipped C-channel, CC2
154 base portion
156 right portion
158 left portion
160 open portion
162 base breadth
164 side portion depth
166 overhanging extension
168 overhanging extension length
170 C-channel thickness
172 rebar
174 rebar length
176 rebar diameter
178 corrugated pipe
180 pipe diameter
182 dowel bar
184 lipped C-channel length
186 concentric hole
188 C-channel extension length
190 concentric hole gap

192 lipped base portion
194 lipped right portion
196 lipped left portion
198 lipped overhanging portion
200 perspective of the adjoining long face
202 fourth indentation
204 fifth indentation
206 roof slab connector
208 first PPVC module
210 second PPVC module
212 three-dimensional coordinate system
214 fourth assembly;
216 the fifth assembly;
220 first opening of the first anchor;
222 second opening of the second anchor;
224 dumbbell coupler;
226 first elongated pole;
227 first top end
228 second elongated pole;
229 first bottom end
230 third elongated pole;
231 second top end
232 fourth elongated pole;
233 second bottom end
234 first end of the dumbbell coupler;
236 second end of the dumbbell coupler;
238 first portion of the dumbbell coupler;
240 second portion of the dumbbell coupler;
242 circular channel;
244 third wall;
246 overlapping zone;
248 bottom portion;
249 top portion
250 floor level
252 first lateral interactional force
254 second lateral interactional force
256 apparatus
258 first holder
260 second holder
262 first distance
264 first recess
266 second recess
268 third recess
270 fourth recess
272 second distance
274 third distance
276 third PPVC
278 first shaft
280 second shaft
282 third shaft
284 first interval
286 second interval
288 first length;
290 second length

The invention claimed is:

1. A Prefabricated Prefinished Volumetric Construction (PPVC) connector for coupling a first PPVC module and a second PPVC module, the PPVC connector comprising:

a first anchor for attaching to the first PPVC module;

a second anchor for attaching to the second PPVC module; and a frame for coupling the first anchor and the second anchor together;

wherein the first anchor, the second anchor, the frame or a combination of any of these comprises a plate for attaching to one of the first and second PPVC modules;

the first PPVC module and the second PPVC module are separated by a grating gap; and the frame comprises at least one coupler, the at least one coupler comprises a dumbbell coupler having at least one shaft with two opposite ends;

wherein the at least one of the opposite ends of the dumbbell coupler comprises at least one elongated pole connected at one of the opposite ends for enlarging the opposite end, a longitudinal axis of the at least one elongated pole is substantially perpendicular to a longitudinal axis of the at least one shaft.

2. The PPVC connector of claim 1, wherein the plate comprises multiple sides for respectively attaching to one of the PPVC modules.

3. The PPVC connector of claim 1, wherein the first anchor, the second anchor, the frame or a combination of any of these are configured to enclose a cavity in-between for receiving a filler in order to create a confinement effect.

4. The PPVC connector of claim 1, wherein the frame comprises at least one plate, at least one rod, or a combination of both.

5. The PPVC connector of claim 4, wherein the at least one plate, at least one rod or a combination of both are configured to extend beyond one of the first and second PPVC module for connecting PPVC modules vertically.

6. The PPVC connector of claim 1, wherein the at least one coupler comprises a first coupler having two wings that are spaced apart for providing a receptacle in order to receive portions of the first anchor and the second anchor, wherein each of the two wings further comprises a lipped portion and a lipped overhanging portion.

7. The PPVC connector of claim 1, wherein the dumbbell coupler which comprises at least one shaft with two opposite ends, one or both of the opposite ends having a larger cross section area than a cross section area of the shaft between the two opposite ends.

8. The PPVC connector of claim 1 further comprising at least one elongated bar that is substantially parallel to at least one of the first anchor, the second anchor or the frame.

9. An assembly of PPVC modules comprising a first PPVC module;

a second PPVC module, wherein the first PPVC module and the second PPVC module are arranged to be separated by a grating gap;

the PPVC connector of claim 1; and a filler at the PPVC connector and the grating gap for joining the first PPVC module and the second PPVC module together by a confinement effect;

wherein the first anchor is attached to the first PPVC module, and the second anchor is attached to the second PPVC module.

10. The assembly of PPVC modules of claim 9, wherein the filler fills a cavity formed by the first anchor, the second anchor, the frame or a combination of any of these.

11. The assembly of PPVC modules of claim 9, further comprising a binder for binding walls of the first PPVC module and the second PPVC module together.

12. A stacked assembly of PPVC modules comprising a first PPVC module;

a second PPVC module attached to the first PPVC module laterally, a third PPVC module attached to the first PPVC module vertically;

wherein the first PPVC module and the third PPVC module share at least a portion of the PPVC connector according to claim 1.

13. The stacked assembly of PPVC modules of claim 12, wherein the PPVC connector comprises a frame that extends to both the first PPVC module and the third PPVC module.

14. The stacked assembly of PPVC modules of claim 12, further comprising a filler in the PPVC connector for joining the first PPVC module, the second PPVC module and the third PPVC module.

15. A method for using a Prefabricated Prefinished Volumetric Construction (PPVC) connector, the method comprising attaching a first plate of a first anchor to a first PPVC module;

attaching a second plate of a second anchor to a second PPVC module;

aligning the first PPVC module and the second PPVC module in order to provide a cavity between the first plate and the second plate; and coupling the first anchor and the second anchor together by a frame in order to prevent detachment between the first PPVC module and the second PPVC module;

wherein the first PPVC module and the second PPVC module are separated by a grating gap;

the frame comprises at least one coupler, the at least one coupler comprises a dumbbell coupler having at least one shaft with two opposite ends;

wherein the at least one of the opposite ends of the dumbbell coupler comprises at least one elongated pole connected at one of the opposite ends for enlarging the opposite end, a longitudinal axis of the at least one elongated pole is substantially perpendicular to a longitudinal axis of the at least one shaft.

16. The method of claim 15 wherein coupling the first anchor and the second anchor further comprises installing a first coupler for providing a receptacle in order to receive portions of the first anchor and the second anchor.

17. The method of claim 15 further comprising filling the cavity between the first anchor, the second anchor and the frame with a filler.

18. A The method for making the PPVC connector of claim 1, the method comprising providing a first plate;

corrugating the first plate for improving surface adhesion of the first plate;

folding the first plate in order to provide a cavity of a first anchor;

providing a second plate;

corrugating the second plate for improving surface adhesion of the second plate;

folding the second plate in order to provide another cavity of a second anchor; and presenting a frame for joining the first anchor and the second anchor at their cavities.

19. The method of claim 18 further comprising offering a frame for coupling the first plate and the second plate as an anchor with another anchor together.

* * * * *